US011114222B2

(12) United States Patent
Karino

(10) Patent No.: US 11,114,222 B2
(45) Date of Patent: Sep. 7, 2021

(54) RESISTIVE ELEMENT AND METHOD OF MANUFACTURING THE SAME

(71) Applicant: FUJI ELECTRIC CO., LTD., Kawasaki (JP)

(72) Inventor: Taichi Karino, Matsumoto (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/856,756

(22) Filed: Apr. 23, 2020

(65) Prior Publication Data

US 2020/0395151 A1 Dec. 17, 2020

(30) Foreign Application Priority Data

Jun. 13, 2019 (JP) ..... JP2019-110579

(51) Int. Cl.
*H01C 1/142* (2006.01)
*H01C 17/28* (2006.01)
*H01C 7/00* (2006.01)

(52) U.S. Cl.
CPC ..... *H01C 1/142* (2013.01); *H01C 7/00* (2013.01); *H01C 17/281* (2013.01)

(58) Field of Classification Search
CPC ..... H01C 1/142; H01C 7/00; H01C 17/281; H01L 24/49; H01L 21/0802; H01L 21/3215; H01L 23/522
See application file for complete search history.

(56) References Cited

U.S. PATENT DOCUMENTS 4,208,781 A * 6/1980 Rao ..... H01L 21/32155 257/E21.004
6,140,910 A 10/2000 Smith et al.
6,316,816 B1 11/2001 Matsumoto
(Continued)

FOREIGN PATENT DOCUMENTS

JP 8-306861 A 11/1996
JP 2003249565 A 5/2003

OTHER PUBLICATIONS

U.S. Notice of Allowance dated Apr. 17, 2019 from U.S. Appl. No. 16/169,094.
(Continued)

*Primary Examiner* — Kyung S Lee

(57) ABSTRACT

A resistive element includes: a semiconductor substrate; a field insulating film deposited on the semiconductor substrate; a plurality of resistive layers separately deposited on the field insulating film; an interlayer insulating film deposited to cover the field insulating film and the resistive layers; a pad-forming electrode deposited on the interlayer insulating film, and electrically connected to one edges of the resistive layers; a relay wire deposited on the interlayer insulating film separately from the pad-forming electrode, and including a first terminal electrically connected to another edges of the resistive layers and a second terminal provided so as to form an ohmic contact to the semiconductor substrate; and a rear surface electrode provided under the semiconductor substrate to form an ohmic contact to the semiconductor substrate, wherein the resistive element uses, as a resistor, an electric channel between the pad-forming electrode and the rear surface electrode.

9 Claims, 31 Drawing Sheets

(56) References Cited

U.S. PATENT DOCUMENTS

| | | | | |
|---|---|---|---|---|
| 6,400,252 | B1 | 6/2002 | Smith et al. | |
| 7,119,657 | B2 | 10/2006 | Ueyanagi et al. | |
| 9,627,409 | B2 | 4/2017 | Moll et al. | |
| 9,660,014 | B2 | 5/2017 | Saito | |
| 2002/0175379 | A1 | 11/2002 | Ueyanagi et al. | |
| 2003/0052329 | A1 | 3/2003 | Kobayashi et al. | |
| 2014/0184303 | A1* | 7/2014 | Hasegawa | H03K 17/567 327/377 |
| 2016/0300912 | A1* | 10/2016 | Tanaka | H01L 27/0802 |
| 2019/0181216 | A1* | 6/2019 | Saito | H01L 21/822 |
| 2020/0051874 | A1* | 2/2020 | Sasaki | H01L 22/32 |

OTHER PUBLICATIONS

U.S. Notice of Allowance dated Mar. 25, 2020 from U.S. Appl. No. 16/171,557.

U.S. Office Action dated Dec. 27, 2019 from U.S. Appl. No. 16/171,557.

U.S. Office Action dated Oct. 3, 2019 from U.S. Appl. No. 16/171,557.

* cited by examiner

RESISTIVE ELEMENT AND METHOD OF MANUFACTURING THE SAME

CROSS-REFERENCE TO RELATED APPLICATION

This application claims benefit of priority under 35 USC 119 based on Japanese Patent Application No. 2019-110579 filed on Jun. 13, 2019, the entire contents of which are incorporated by reference herein.

BACKGROUND OF THE INVENTION

1. Field of the Invention

The present invention relates to a resistive element used as a gate resistive element of a switching element, and a method of manufacturing the resistive element.

2. Description of the Related Art

JP H08-306861 A discloses a resistive element used for a semiconductor device such as a semiconductor integrated circuit (IC), and including a silicon substrate, an insulating layer deposited on the silicon substrate, and a resistive layer of a thin film deposited on the insulating layer. The resistive element disclosed in JP H08-306861 A further includes two electrodes at side edges opposed to each other in the resistive layer, and aluminum thin wires bonded to the two electrodes.

The resistive element disclosed in JP H08-306861 A is provided with the two electrodes present on the top surface of the resistive layer and connected to the side edges opposed to each other. This structure inevitably increases the chip size and requires the two bonding wires connected to the two electrodes.

SUMMARY OF THE INVENTION

In view of the foregoing problems, the present invention provides a resistive element with a chip size reduced and the number of bonding wires decreased, and a method of manufacturing the resistive element.

An aspect of the present invention inheres in a resistive element including: a semiconductor substrate; a field insulating film deposited on the semiconductor substrate; a plurality of resistive layers separately deposited on the field insulating film; an interlayer insulating film deposited to cover the field insulating film and the plurality of resistive layers; a pad-forming electrode deposited on the interlayer insulating film, and electrically connected to one edge of at least one resistive layer selected from the plurality of resistive layers; a relay wire deposited on the interlayer insulating film separately from the pad-forming electrode, and including a first terminal electrically connected to another edge of the selected resistive layer and a second terminal provided so as to form an ohmic contact to the semiconductor substrate; and a rear surface electrode provided under the semiconductor substrate to form an ohmic contact to the semiconductor substrate, wherein the resistive element uses, as a resistor, an electric channel between the pad-forming electrode and the rear surface electrode.

Another aspect of the present invention inheres in a method of manufacturing a resistive element, including: depositing a field insulating film on a semiconductor substrate; depositing a plurality of resistive layers on the field insulating film; depositing an interlayer insulating film to cover the field insulating film and the plurality of resistive layers; forming, in the interlayer insulating film, a first contact hole on which one edge of one resistive layer selected from the plurality of resistive layers is exposed, a second contact hole on which another edge of the selected resistive layer is exposed at position separated from the first contact hole, and a third contact hole on which a top surface of the semiconductor substrate is partly exposed at position separated from the first and second contact holes; forming a pad-forming electrode electrically connected to the one edge of the selected resistive layer via the first contact hole, and a relay wire electrically connected to another edge of the selected resistive layer via the second contact hole to form an ohmic contact to the semiconductor substrate via the third contact hole; and forming a rear surface electrode under the semiconductor substrate, wherein the resistive element uses, as a resistor, an electric channel between the at least one pad-forming electrode and the rear surface electrode.

DETAILED DESCRIPTION

Figure 1:
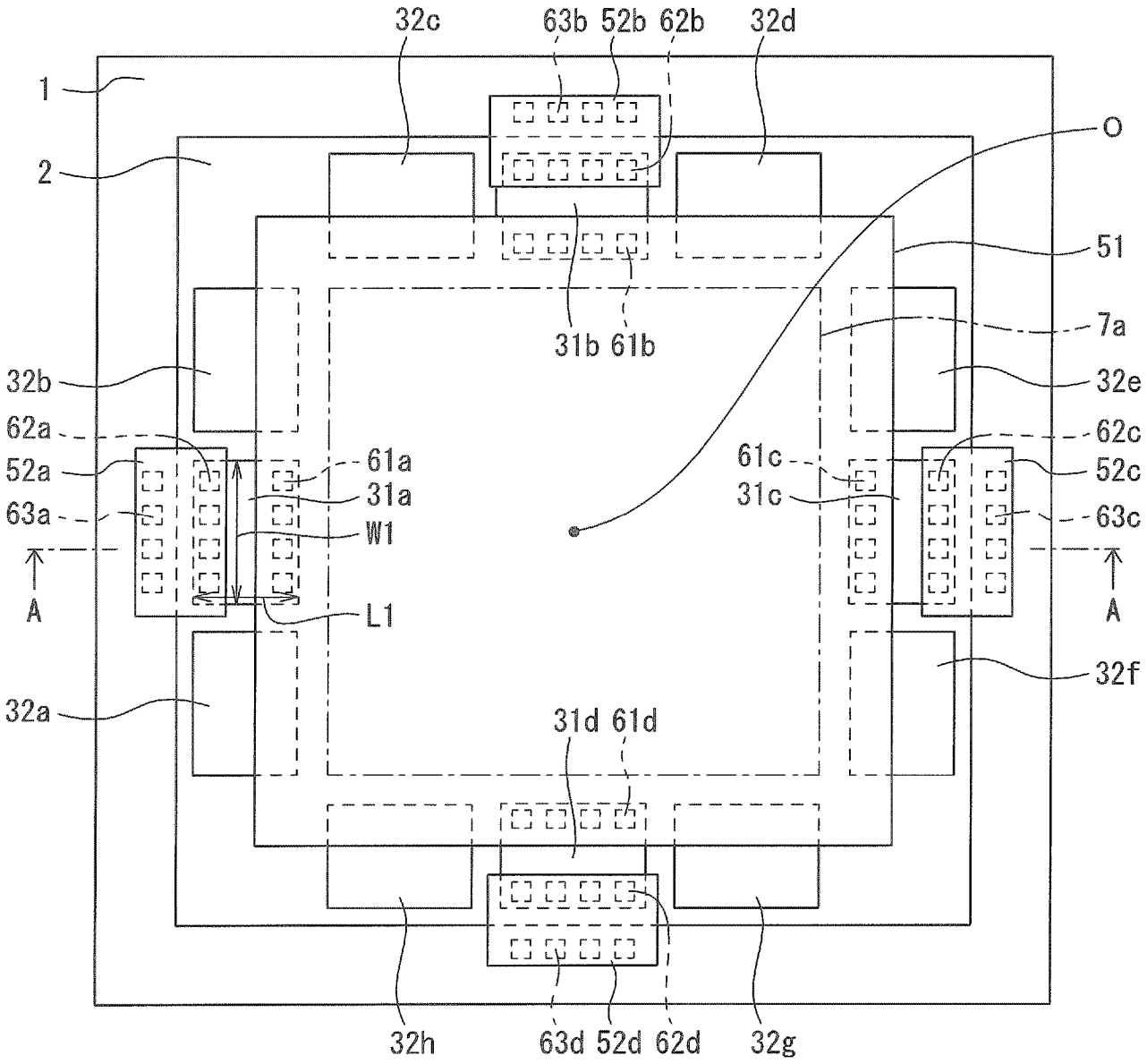
FIG. 1 is a plan view illustrating a resistive element according to an embodiment of the present invention.

With reference to the Drawings, embodiments and modified examples of the present invention will be described below. In the Drawings, the same or similar elements are indicated by the same or similar reference numerals. The Drawings are schematic, and it should be noted that the relationship between thickness and planer dimensions, the thickness proportion of each layer, and the like are different from real ones. Accordingly, specific thicknesses or dimensions should be determined with reference to the following description. Moreover, in some drawings, portions are illustrated with different dimensional relationships and proportions. The embodiments described below merely illustrate schematically devices and methods for specifying and giving shapes to the technical idea of the present invention, and the span of the technical idea is not limited to materials, shapes, structures, and relative positions of elements described herein. Further, definitions of directions such as an up-and-down direction in the following description are merely definitions for convenience of understanding, and are not intended to limit the technical ideas of the present invention. For example, as a matter of course, when the subject is observed while being rotated by 90°, the subject is understood by converting the up-and-down direction into the right-and-left direction. When the subject is observed while being rotated by 180°, the subject is understood by inverting the up-and-down direction. When the subject is observed while being rotated by 180°, the definitions of "front" and "back" are reversed.

EMBODIMENT

<Resistive Element>

A resistive element according to an embodiment of the present invention has a rectangular planar pattern surrounded by the first to fourth sides, as illustrated in FIG. 1. The resistive element according to the embodiment has a chip size of about 3×3 millimeters, for example, which may be determined as appropriate. While the chip illustrated in FIG. 1 has a rectangular shape, the chip of the resistive element according to the embodiment is not limited to this shape. The resistive element according to the embodiment includes, along the circumference of the chip having the shape illustrated in FIG. 1, a first resistive layer 31*a* arranged on the first side, a second resistive layer 31*b* arranged on the second side, a third resistive layer 31*c* arranged on the third side, and a fourth resistive layer 31*d* arranged on the fourth side. As used herein, the names of the elements "first resistive layer 31*a*" to "fourth resistive layer 31*d*" are indicated by the ordinal numerals for illustration purposes, and the first resistive layer 31*a* to the fourth resistive layer 31*d* can be collectively referred to as "a plurality of resistive layers".

Figure 2:
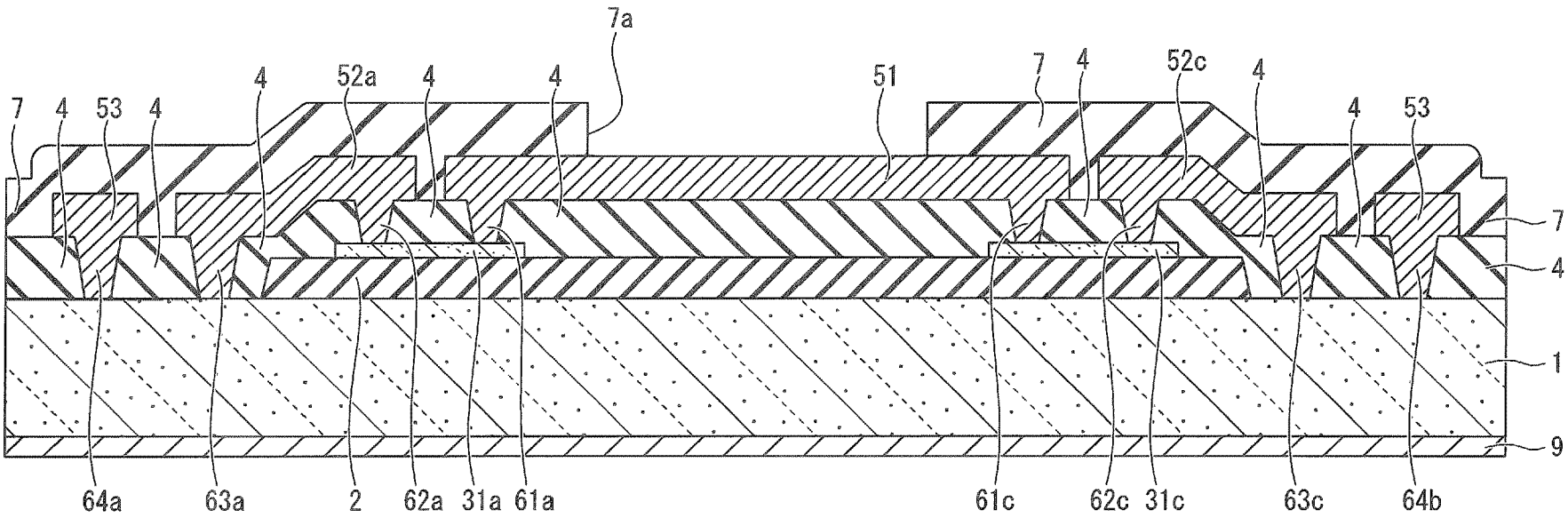
FIG. 2 is a cross-sectional view as viewed from direction A-A in FIG. 1.

The resistive element according to the embodiment of the present invention includes, in a cross-sectional structure as illustrated in FIG. 2, a semiconductor substrate 1 having a low specific resistivity, a field insulating film (a first insulating film) 2 deposited on the semiconductor substrate 1, and the first resistive layer 31*a* and the third resistive layer 31*c* of thin films deposited on the field insulating film 2. Although not illustrated in the cross-sectional view of FIG. 2, the second resistive layer 31*b* and the fourth resistive layer 31*d* illustrated in FIG. 1 are also deposited on the field insulating film 2 in the same manner as the first resistive layer 31*a* and the third resistive layer 31*c* illustrated in FIG. 2.

The semiconductor substrate 1 has a thickness of about 350 micrometers, for example. The semiconductor substrate 1 may be a substrate, such as a silicon substrate, having a low specific resistivity and doped with n-type impurity ions at a high concentration. The content of a resistive component of the semiconductor substrate 1 is preferably decreased to a level which can be ignored with respect to a resistive component of the first resistive layer 31*a* to the fourth resistive layer 31*d*. In particular, the content of the resistive component of the semiconductor substrate 1 is preferably about one hundredth or less of that of the first resistive layer 31*a* to the fourth resistive layer 31*d*. The specific resistivity of the semiconductor substrate 1 may be set in a range of about 2 to 60 mΩ·cm. Alternatively, the semiconductor substrate 1 used may be a silicon substrate doped with p-type impurity ions at a high concentration, or a semiconductor substrate made of material other than silicon.

The field insulating film 2 has a thickness of about 800 nanometers, for example. Increasing the thickness of the field insulating film 2 can reduce a parasitic capacitance. The field insulating film 2 may be a silicon oxide film (a $SiO_2$ film), a silicon nitride film (a $Si_3N_4$ film), or a composite film of these films. The field insulating film 2 may also be an insulating film (a TEOS film) obtained by a chemical vapor deposition (CVD) method using tetraethoxysilane (TEOS) gas of an organic silicon compound.

As illustrated in FIG. 1, the first resistive layer 31*a* to the fourth resistive layer 31*d* have a rectangular planar pattern. The first resistive layer 31*a* to the fourth resistive layer 31*d* have a thickness of about 500 nanometers, and a sheet resistance of about 150 Ω/sq, for example. The first resistive layer 31*a* to the fourth resistive layer 31*d* may each be a doped polysilicon (DOPOS) layer of n-type, for example. The n-type DOPOS layer can be obtained such that n-type impurity ions such as phosphorus (P) are implanted in polycrystalline silicon (polysilicon), or such that n-type impurity ions are doped in polycrystalline silicon upon the deposition with a CVD device. A resistance value of the first resistive layer 31*a* to the fourth resistive layer 31*d* can be regulated such that a width W1 and a length L1 of the first resistive layer 31*a* to the fourth resistive layer 31*d* are adjusted. The resistance value of the first resistive layer 31*a* to the fourth resistive layer 31*d* can also be regulated, when using the DOPOS layer, such that the amount of impurity ions doped to the polysilicon is adjusted.

The first resistive layer 31*a* to the fourth resistive layer 31*d* preferably have a temperature coefficient of zero ppm/° C. or lower, namely, the first resistive layer 31*a* to the fourth resistive layer 31*d* preferably have a temperature coefficient of zero or a negative number. The temperature coefficient set as described above can avoid an increase in the resistance value during operation at a high temperature. When the resistive element according to the embodiment is used as a gate resistive element of an insulated gate bipolar transistor (IGBT), for example, a loss of the IGBT when turned on can be suppressed. The temperature coefficient of the DOPOS can be regulated such that a dose of impurity ions implanted in the polysilicon is adjusted. For example, when the dose is set to about $7.0\times10^{15}$ $cm^{-2}$ or less, the temperature coefficient of the DOPOS can be set to zero ppm/° C. or lower. The temperature coefficient of the first resistive layer 31*a* to the fourth resistive layer 31*d* is not intended to be limited to zero ppm/° C. or lower. The first resistive layer 31*a* to the fourth resistive layer 31*d* may have a temperature coefficient of a positive number.

The first resistive layer 31*a* to the fourth resistive layer 31*d* may be a DOPOS layer of p-type. The p-type DOPOS layer can also be obtained such that p-type impurity ions such as boron (B) are implanted in polysilicon, for example. The first resistive layer 31*a* to the fourth resistive layer 31*d* are not limited to the DOPOS layer, and may be a nitride film of transition metal such as tantalum nitride ($TaN_x$), or a stacked metallic film including a chromium (Cr) film, a nickel (Ni) film, and a manganese (Mn) film stacked in this order and having a high melting point. Alternatively, the first resistive layer 31*a* to the fourth resistive layer 31*d* may each be a thin film of silver-palladium (AgPd) or ruthenium oxide ($RuO_2$). Alternatively, the first resistive layer 31*a* to the fourth resistive layer 31*d* may be implemented by p-type diffusion layers or n-type diffusion layers deposited on the semiconductor surface, which differ from the structure illustrated in FIG. 1 and FIG. 2.

As illustrated on the left side in FIG. 1, a first dummy layer 32*a* and a second dummy layer 32*b* are arranged separately from the first resistive layer 31*a* on the first side of the square shape to interpose the first resistive layer 31*a*. As illustrated on the upper side in FIG. 1, a third dummy layer 32*c* and a fourth dummy layer 32*d* are arranged separately from the second resistive layer 31*b* on the second side of the square shape to interpose the second resistive layer 31*b*. As illustrated on the right side in FIG. 1, a fifth dummy layer 32*e* and a sixth dummy layer 32*f* are arranged separately from the third resistive layer 31*c* on the third side to interpose the third resistive layer 31*c*. As illustrated on the lower side in FIG. 1, a seventh dummy layer 32*g* and an eighth dummy layer 32*h* are arranged separately from the fourth resistive layer 31*d* on the fourth side to interpose the fourth resistive layer 31*d*. As used herein, the names of the elements "first dummy layer 32*a*" to "eighth dummy layer 32*h*" are indicated by the ordinal numerals for illustration purposes, and the first dummy layer 32*a* to the eighth dummy layer 32*h* can be collectively referred to as "a plurality of dummy layers".

The first dummy layer 32*a* to the eighth dummy layer 32*h* include the same material as the first resistive layer 31*a* to the fourth resistive layer 31*d* such as the n-type DOPOS, and have the same thickness as the first resistive layer 31*a* to the fourth resistive layer 31*d*. The first dummy layer 32*a* to the eighth dummy layer 32*h* may have the same width W1 and the length L1 as the first resistive layer 31*a* to the fourth resistive layer 31*d*, or may have a different width and length. The first dummy layer 32*a* to the eighth dummy layer 32*h* are not necessarily provided.

Although not illustrated in FIG. 1, an interlayer insulating film (a second insulating film) 4 is deposited to cover the field insulating film 2 and the first resistive layer 31*a* to the fourth resistive layer 31*d*, as illustrated in FIG. 2. The interlayer insulating film 4 has a thickness of about 1,500 nanometers, for example. The interlayer insulating film 4 may be a silicon oxide film (a $SiO_2$ film) without containing phosphorus (P) or boron (B) which is typically referred to as a non-doped silicate glass (NSG) film, a phosphosilicate glass film (a PSG film), a borosilicate glass film (a BSG film), a single-layer film of a borophosphosilicate glass film (a BPSG film) or a silicon nitride ($Si_3N_4$) film, or a composite film of any of the above films combined together. For example, the interlayer insulating film 4 may be a composite film including a NSG film with a thickness of about 770 nanometers and a PSG film with a thickness of about 650 nanometers stacked together. The NSG film is presumed to decrease a variation in resistance. The PSG film is presumed to ensure the strength of the wire bonding.

A pad-forming electrode 51 is allocated above the field insulating film 2, as illustrated in FIG. 2. The pad-forming electrode 51 has a rectangular planar pattern as illustrated in FIG. 1. The center O of the pad-forming electrode 51 in the rectangular planar pattern is common to the center of the chip. As illustrated in FIG. 1 and FIG. 2, the left edge portion of the pad-forming electrode 51 overlaps with one edge on the right side of the first resistive layer 31*a* in the depth direction. The pad-forming electrode 51 is connected to the one edge of the first resistive layer 31*a* via first electrode contact regions 61*a*.

As illustrated in FIG. 1, the upper edge portion of the pad-forming electrode 51 overlaps with one edge of the second resistive layer 31*b* in the depth direction. The pad-forming electrode 51 is connected to the one edge of the second resistive layer 31*b* via second electrode contact regions 61*b*. As illustrated in FIG. 1 and FIG. 2, the right edge portion of the pad-forming electrode 51 overlaps with one edge on the left side of the third resistive layer 31*c* in the depth direction. The pad-forming electrode 51 is connected to the one edge of the third resistive layer 31*c* via third electrode contact regions 61*c*. As illustrated in FIG. 1, the lower edge portion of the pad-forming electrode 51 overlaps with one edge of the fourth resistive layer 31*d* in the depth direction. The pad-forming electrode 51 is connected to the one edge of the fourth resistive layer 31*d* via fourth electrode contact regions 61*d*.

As illustrated in FIG. 1 and FIG. 2, a first relay wire 52*a*, a second relay wire 52*b*, a third relay wire 52*c*, and a fourth relay wire 52*d* are deposited on the interlayer insulating film 4 to separately surround the pad-forming electrode (the front surface electrode) 51 located in the middle. As illustrated in FIG. 1, the first relay wire 52*a* is arranged on the first side of the rectangular shape. The second relay wire 52*b* is arranged on the second side of the rectangular shape. The third relay wire 52*c* is arranged on the third side of the rectangular shape. The fourth relay wire 52*d* is arranged on the fourth side of the rectangular shape. As used herein, the names of the elements "first relay wire 52*a*" to "fourth relay wire 52*d*" are indicated by the ordinal numerals for illustration purposes, and the first relay wire 52*a* to the fourth relay wire 52*d* can be collectively referred to as "a plurality of relay wires".

The planar pattern including the pad-forming electrode 51, the first resistive layer 31*a* to the fourth resistive layer 31*d*, and the first relay wire 52*a* to the fourth relay wire 52*d* has four-fold rotational symmetry about the center O of the chip. This arrangement allows the resistive element according to the embodiment to be turned by 90 or 180 degrees upon packaging, so as to facilitate the process of assembly.

As illustrated in FIG. 2, the right edge portion of the first relay wire 52*a* overlaps with the other edge of the first resistive layer 31*a* in the depth direction. A resistive layer connection terminal, which is one edge (a first edge portion) of the first relay wire 52*a*, is in contact with the other edge of the first resistive layer 31*a* via first wire contact regions 62*a*. The left edge portion of the third relay wire 52*c* overlaps with the other edge of the third resistive layer 31*c* in the depth direction. A resistive layer connection terminal, which is one edge (a first edge portion) of the third relay wire 52*c*, is in contact with the other edge of the third resistive layer 31*c* via third wire contact regions 62*c*.

Although not illustrated, the edge portion of the second relay wire 52*b* overlaps with the other edge of the second resistive layer 31*b* in the depth direction on the back side of the sheet of FIG. 2. A resistive layer connection terminal, which is one edge (a first edge portion) of the second relay wire 52*b*, is in contact with the other edge of the second resistive layer 31*b* via second wire contact regions 62*b*. The edge portion of the fourth relay wire 52*d* overlaps with the other edge of the fourth resistive layer 31*d* in the depth direction on the front side of the sheet of FIG. 2. A resistive layer connection terminal, which is one edge (a first edge portion) of the fourth relay wire 52*d*, is in contact with the other edge of the fourth resistive layer 31*d* via fourth wire contact regions 62*d*.

As illustrated in FIG. 1 and FIG. 2, a substrate connection terminal, which is the other edge (a second edge portion) of each of the first relay wire 52*a* to the fourth relay wire 52*d*, forms an ohmic contact to the semiconductor substrate 1 at a low contact resistance via first substrate contact regions 63*a* to fourth substrate contact regions 63*d*. Contact regions having the same conductivity type as the semiconductor substrate 1 and having a higher impurity concentration (a lower specific resistivity) than the semiconductor substrate 1 may be provided in the upper portion of the semiconductor substrate 1 at the contact positions between the semiconductor substrate 1 and each of the first substrate contact regions 63*a* to the fourth substrate contact regions 63*d*.

The pad-forming electrode 51 and the first relay wire 52*a* to the fourth relay wire 52*d* have a thickness of about three micrometers, for example. The pad-forming electrode 51 and the first relay wire 52*a* to the fourth relay wire 52*d* may be a stacked film including a titanium/titanium nitride (Ti/TiN) film with a thickness of about 120 nanometers serving as barrier metal, an aluminum-silicon (Al—Si) film with a thickness of about three micrometers, and a TiN/Ti film with a thickness of about 45 nanometers serving as a reflection preventing film. Instead of Al—Si, Al or an Al alloy such as Al—Cu—Si or Al—Cu may be used. The pad-forming electrode 51 is connected with a bonding wire (not illustrated) having a diameter of about 300 micrometers made of metal such as aluminum (Al).

Although not illustrated in FIG. 1, a guard ring layer 53 is arranged on the interlayer insulating film 4, as illustrated in FIG. 2. The guard ring layer 53 is delineated into a ring shape along the outer periphery of the chip of the resistive element according to the embodiment. The guard ring layer 53 is in contact with the semiconductor substrate 1 via peripheral contact regions 64*a* and 64*b*. The guard ring layer 53 includes the same material as the pad-forming electrode 51 and the first relay wire 52*a* to the fourth relay wire 52*d*. The guard ring layer 53 can prevent moisture from entering from the side surface of the chip.

As illustrated in FIG. 2, a passivation insulating film (a third insulating film: a passivation film) 7 is laminated on the pad-forming electrode 51, the first relay wire 52*a* to the fourth relay wire 52*d* and the guard ring layer 53. The passivation insulating film 7 may be a composite film including a TEOS film, a $Si_3N_4$ film, and a polyimide film stacked in this order. The passivation insulating film 7 is provided with an opening 7*a*. FIG. 1 indicates only the opening 7*a* by the dash-dotted line while omitting the illustration of the passivation insulating film 7. The part of the pad-forming electrode 51 exposed on the opening 7*a* serves as a pad region to be connected with the bonding wire.

As illustrated in FIG. 2, a rear surface electrode (a counter electrode) 9 is provided on the bottom surface of the semiconductor substrate 1. The rear surface electrode 9 may be a single film made of gold (Au), or a metallic film including a titanium (Ti) film, a nickel (Ni) film, and a gold (Au) film stacked in this order. The outermost layer of the rear surface electrode 9 may be made of material which can be soldered. The rear surface electrode 9 is fixed to a metal plate (not shown) by soldering, for example. The resistive element according to the embodiment includes the four resistive layers of the first resistive layer 31*a* to the fourth resistive layer 31*d* connected in parallel between the pad-forming electrode 51 and the rear surface electrode 9 so as to implement a vertical resistive element having electric channels serving as resistors between the pad-forming electrode 51 and the rear surface electrode 9.

The resistive element according to the embodiment including the four resistive layers can selectively use the first resistive layer 31*a* to the fourth resistive layer 31*d* such that the presence or absence of each of the first electrode contact regions 61*a* to the fourth electrode contact regions 61*d*, the first wire contact regions 62*a* to the fourth wire contact regions 62*d*, and the first substrate contact regions 63*a* to the fourth substrate contact regions 63*d* is determined. For example, when the first resistive layer 31*a* is chosen from the first resistive layer 31*a* to the fourth resistive layer 31*d* to be used, at least the first electrode contact regions 61*a*, the first wire contact regions 62*a*, and the first substrate contact regions 63*a* are only required to be provided, each being chosen from the first electrode contact regions 61*a* to the fourth electrode contact regions 61*d*, the first wire contact regions 62*a* to the fourth wire contact regions 62*d*, and the first substrate contact regions 63*a* to the fourth substrate contact regions 63*d*.

When the first resistive layer 31*a* to the fourth resistive layer 31*d* each have a resistance value of 120Ω, and one of the first resistive layer 31*a* to the fourth resistive layer 31*d* is connected, the resistive element according to the embodiment has a resistance value of 120Ω. When three of the first resistive layer 31*a* to the fourth resistive layer 31*d* are connected in parallel, the resistive element according to the embodiment has a resistance value of 40Ω. When two of the first resistive layer 31*a* to the fourth resistive layer 31*d* are connected in parallel, the resistive element according to the embodiment has a resistance value of 60Ω. When all of the first resistive layer 31*a* to the fourth resistive layer 31*d* are connected in parallel as illustrated in FIG. 1 and FIG. 2, the resistive element according to the embodiment has a resistance value of 30Ω. The increase/decrease in the number of the first resistive layer 31*a* to the fourth resistive layer 31*d* connected in parallel thus can regulate the resistance value of the resistive element according to the embodiment.

Figure 3:
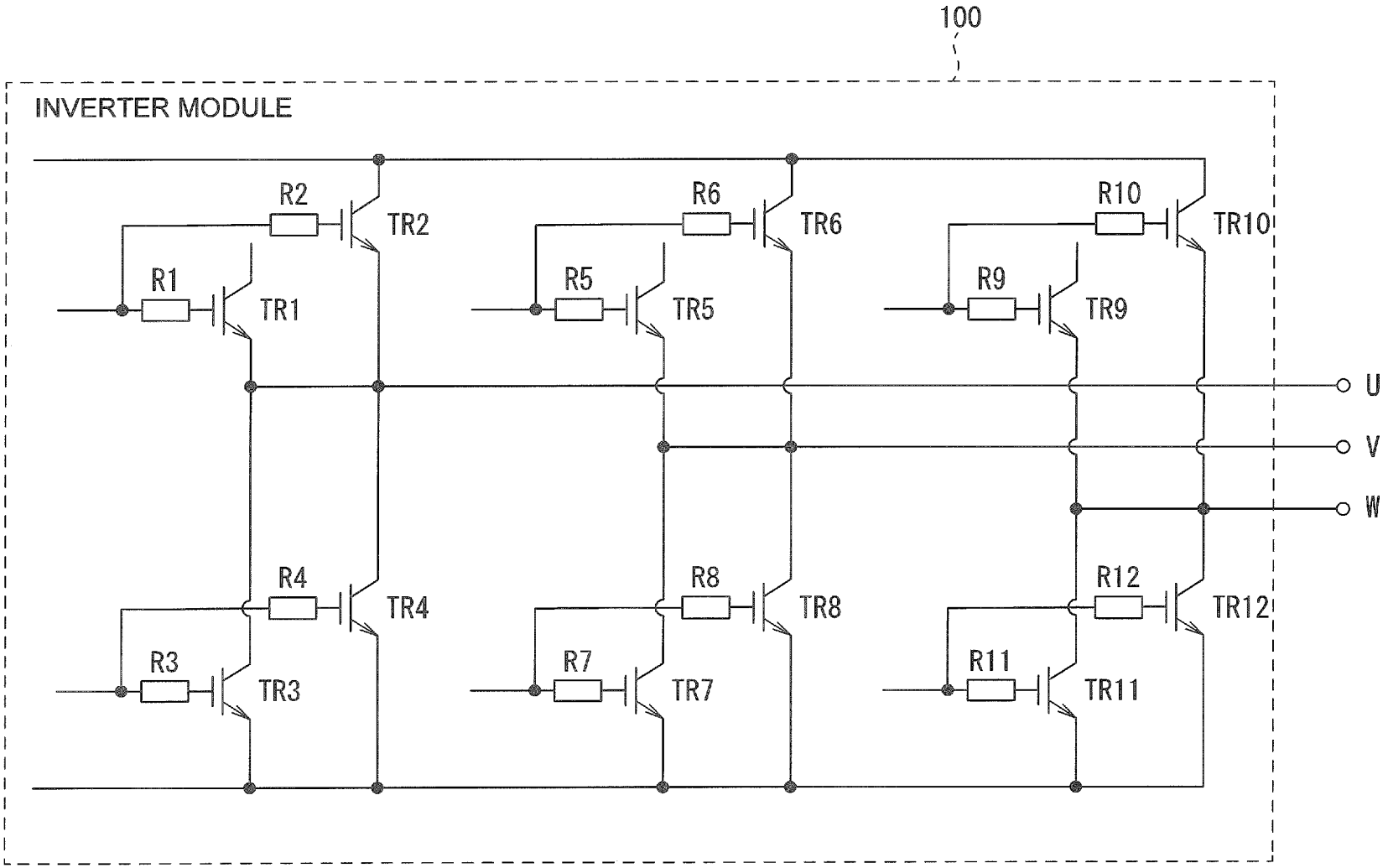
FIG. 3 is a circuit diagram illustrating an application example of the resistive element according to the embodiment.

The resistive element according to the embodiment can be used for an inverter module 100 for driving a three-phase motor having a u-phase, a v-phase, and a w-phase, for example, as illustrated in FIG. 3. The inverter module 100 includes a first main element TR1, a second main element TR2, a third main element TR3, and a fourth main element TR4 for driving the u-phase. The inverter module 100 also includes a fifth main element TR5, a sixth main element TR6, a seventh main element TR7, and an eighth main element TR8 for driving the v-phase, and a ninth main element TR9, a tenth main element TR10, an eleventh main element TR11, and a twelfth main element TR12 for driving the w-phase. The first main element TR1 to the twelfth main element TR12 are each connected to a freewheeling diode (not shown). The first main element TR1 to the twelfth main element TR12 may each be an IGBT. The gate electrodes of the IGBTs are connected with a first gate resistive element R1 to a twelfth gate resistive element R12 so as to avoid an oscillation phenomenon during the switching operation.

The resistive element according to the embodiment can be used as each of the first gate resistive element R1 to the twelfth gate resistive element R12. For example, when the resistive element according to the embodiment is used as the first gate resistive element R1, the terminal on the side on which the gate resistive element R1 is connected to the gate electrode of the first main electrode TR1 corresponds to the terminal toward the pad-forming electrode 51 illustrated in FIG. 1 and FIG. 2. The other terminal on the side opposite to the side on which the gate resistive element R1 is connected to the gate electrode of the first main electrode TR1 corresponds to the terminal toward the rear surface electrode 9 illustrated in FIG. 2.

The resistive element according to the embodiment includes the four resistive layers of the first resistive layer 31*a* to the fourth resistive layer 31*d* connected in parallel between the pad-forming electrode 51 and the rear surface electrode 9 so as to implement the vertical resistive element having electric channels serving as resistors between the pad-forming electrode 51 and the rear surface electrode 9. The resistive element according to the embodiment includes a single pad region implemented by the top surface of the pad-forming electrode 51 connected with the first resistive layer 31*a* to the fourth resistive layer 31*d*, and thus only requires a single bonding wire, so as to decrease the total number of the bonding wires, as compared with a lateral resistive element. Further, the area of the pad region on the top surface side can be decreased as compared with a lateral resistive element, decreasing the size of the chip accordingly.

The resistive element according to the embodiment can selectively use any of or all of the first resistive layer 31*a* to the fourth resistive layer 31*d* such that the presence or absence of each of the first electrode contact regions 61*a* to the fourth electrode contact regions 61*d*, the first wire contact regions 62*a* to the fourth wire contact regions 62*d*, and the first substrate contact regions 63*a* to the fourth substrate contact regions 63*d* is determined. Determining the number of the first resistive layer 31*a* to the fourth resistive layer 31*d* connected in parallel as appropriate depending on the purpose of the resistive element according to the embodiment, can regulate the resistance value of the resistive element according to the embodiment.

Method of Manufacturing Resistive Element

A method of manufacturing the resistive element according to the embodiment of the present invention is illustrated below with reference to FIG. 4 to FIG. 13. It should be understood that the method of manufacturing the resistive element is an example, and the embodiment can be implemented by various manufacturing methods other than the following method including modified examples within the scope of the invention as defined by the appended claims.

Figure 4:
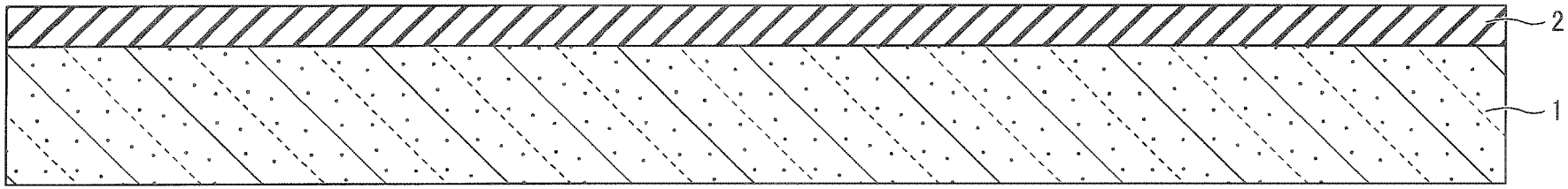
FIG. 4 is a cross-sectional view illustrating a process of manufacturing the resistive element according to the embodiment.

First, the semiconductor substrate 1 such as a silicon substrate doped with n-type impurity ions at a high concentration is prepared. As illustrated in FIG. 4, the field insulating film 2 such as a TEOS film is deposited on the semiconductor substrate 1 by a low-pressure CVD (LPCVD) method, for example. The field insulating film 2 may be a composite film including a thermal oxide film formed by a thermal oxidation method and an insulating film further deposited on the thermal oxide film by a CVD method so as to be stacked together.

Figure 5:
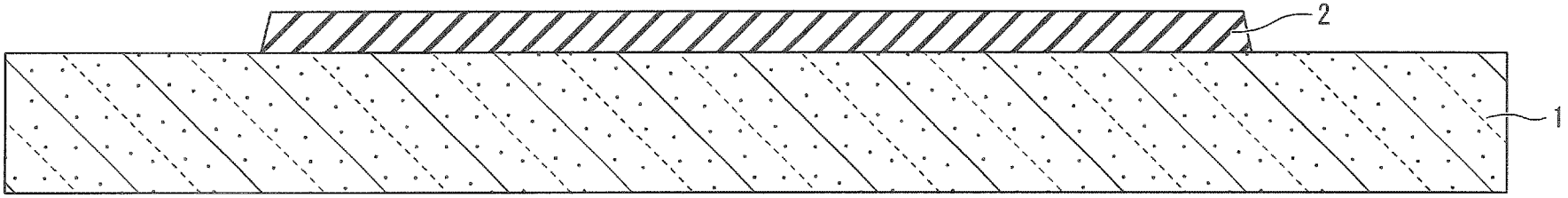
FIG. 5 is a cross-sectional view, continued from FIG. 4, illustrating the process of manufacturing the resistive element according to the embodiment.

A photoresist film is then coated on the top surface of the field insulating film 2, and is delineated by photolithography. Using the delineated photoresist film as an etching mask, a part of the field insulating film 2 is selectively removed by dry etching such as reactive ion etching (RIE). The photoresist film is then removed, so as to partly provide the pattern of the field insulating film 2 on the top surface of the semiconductor substrate 1, as illustrated in FIG. 5.

Figure 6:
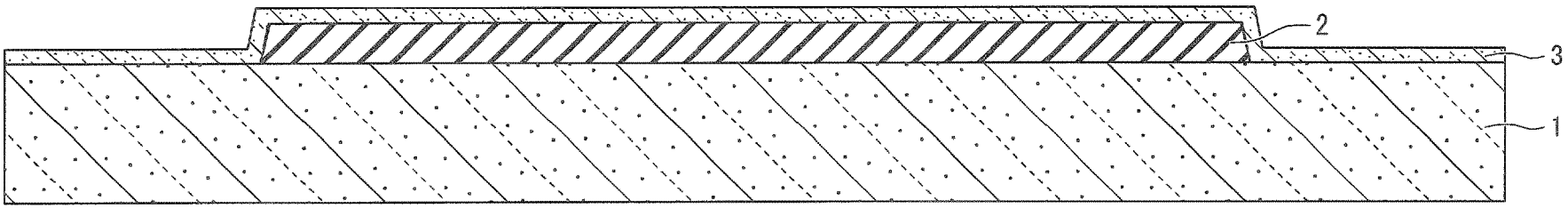
FIG. 6 is a cross-sectional view, continued from FIG. 5, illustrating the process of manufacturing the resistive element according to the embodiment.

Next, a non-doped polysilicon layer is formed on the semiconductor substrate 1 and the field insulating film 2 by a CVD method, for example. N-type impurity ions such as phosphorus (P) are implanted in the polysilicon layer. For example, the phosphorus (P) impurity ions are implanted under the conditions of an acceleration voltage of 80 keV and a dose of about $6.0\times10^{15}$ $cm^{-2}$ or less. The impurity ions implanted are activated by annealing, so as to form the DOPOS layer 3 doped with the n-type impurity ions at a high concentration on the top surface, as illustrated in FIG. 6.

Figure 7:
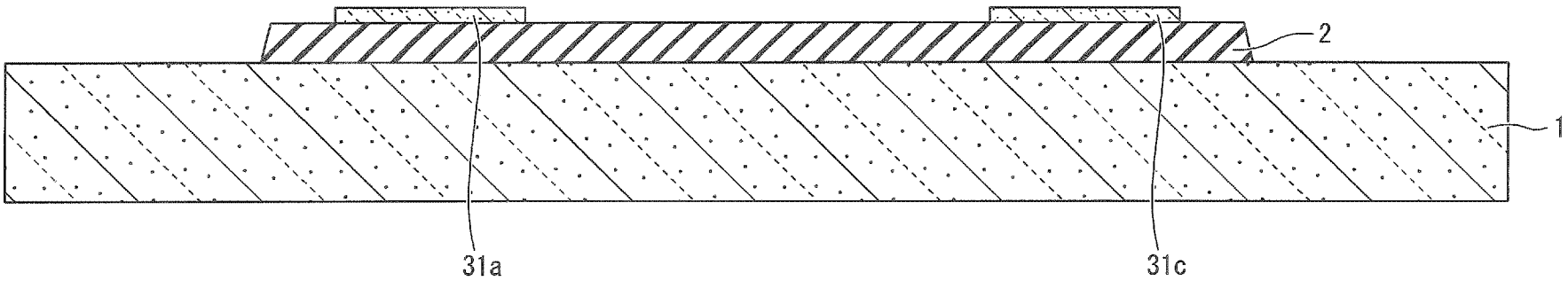
FIG. 7 is a cross-sectional view, continued from FIG. 6, illustrating the process of manufacturing the resistive element according to the embodiment.

A photoresist film is then coated on the top surface of the DOPOS film 3, and is delineated by photolithography. Using the delineated photoresist film as an etching mask, a part of the DOPOS layer 3 is selectively removed by RIE, for example. The photoresist film is then removed, so as to form the first resistive layer 31*a* and the third resistive layer 3*c* on the field insulating film 2, as illustrated in FIG. 7. At the same time, the second resistive layer 31*b* and the fourth resistive layer 31*d* illustrated in FIG. 1 are also formed on the field insulating film 2.

Figure 8:
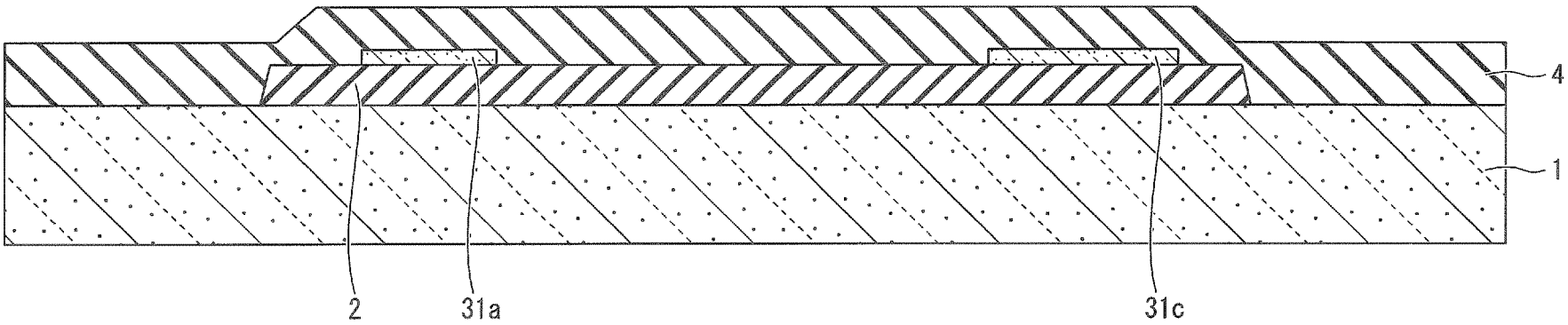
FIG. 8 is a cross-sectional view, continued from FIG. 7, illustrating the process of manufacturing the resistive element according to the embodiment.

Next, as illustrated in FIG. 8, the interlayer insulating film 4 is deposited to cover the field insulating film 2 and the first resistive layer 31*a* to the fourth resistive layer 31*d*. The interlayer insulating film 4 may be made of a composite film including a NSG film and a PSG film sequentially stacked by a CVD method, for example.

Figure 9:
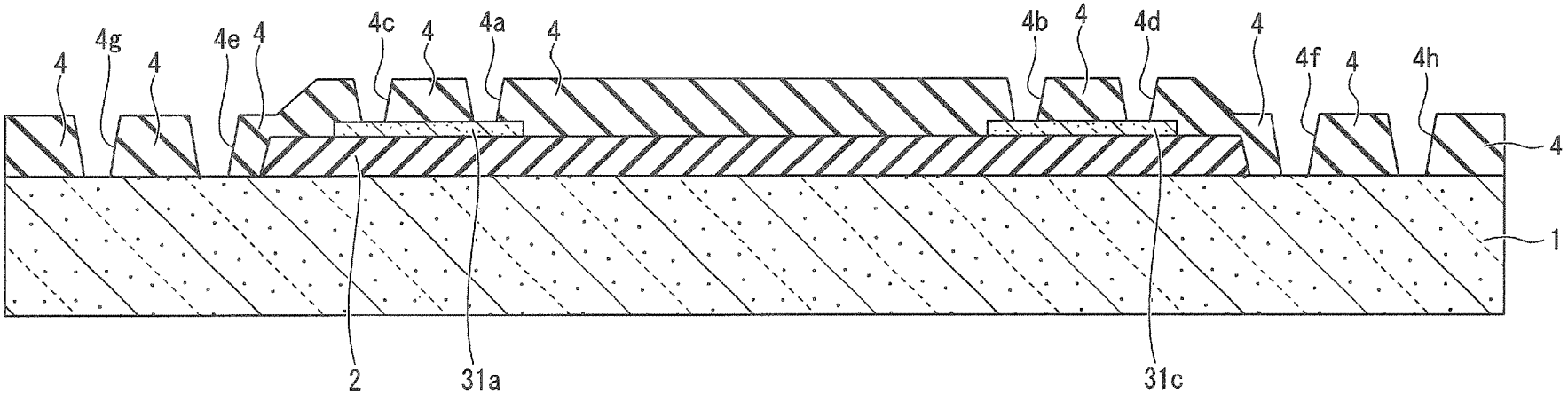
FIG. 9 is a cross-sectional view, continued from FIG. 8, illustrating the process of manufacturing the resistive element according to the embodiment.

A photoresist film is then coated on the interlayer insulating film 4, and is delineated by photolithography. Using the delineated photoresist film as an etching mask, a part of the interlayer insulating film 4 is selectively removed by RIE, for example. The photoresist film is then removed, so as to open first pad contact holes 4*a* and third pad contact holes 4*b* in the interlayer insulating film 4, as illustrated in FIG. 9. Although not illustrated, the interlayer insulating film 4 is simultaneously provided with second pad contact holes open on the back side of the sheet of FIG. 9 and fourth pad contact holes open on the front side of the sheet of FIG. 9. As used herein, the first to fourth pad contact holes are correctively referred to as "first contact holes".

At the same time, first inner relay contact holes 4*c* and third inner relay contact holes 4*d* are provided together with the first contact holes. Although not illustrated, the interlayer insulating film 4 is simultaneously provided with second inner relay contact holes open on the back side of the sheet of FIG. 9 and fourth inner relay contact holes open on the front side of the sheet of FIG. 9. As used herein, the first to fourth inner relay contact holes are correctively referred to as "second contact holes".

At the same time, first outer relay contact holes 4*e* and third outer relay contact holes 4*f* are provided together with the first and second contact holes. Although not illustrated, the interlayer insulating film 4 is simultaneously provided with second outer relay contact holes open on the back side of the sheet of FIG. 9 and fourth outer relay contact holes open on the front side of the sheet of FIG. 9. As used herein, the first to fourth outer relay contact holes are correctively referred to as "third contact holes". Further, guard ring contact holes 4*g* and 4*h* are open together with the first to third contact holes.

Figure 10:
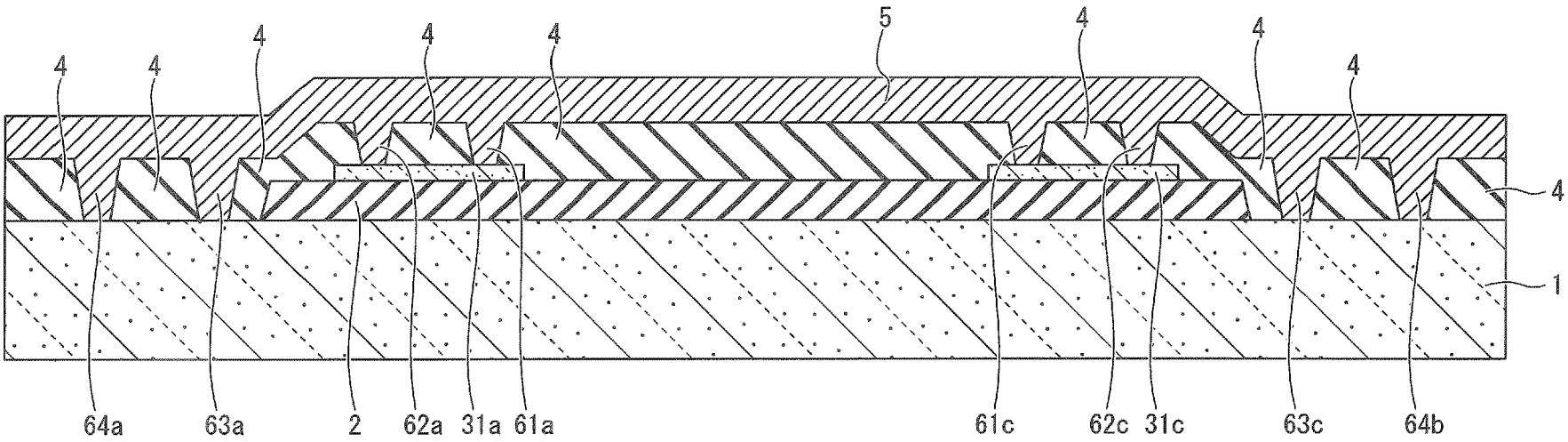
FIG. 10 is a cross-sectional view, continued from FIG. 9, illustrating the process of manufacturing the resistive element according to the embodiment.

Next, as illustrated in FIG. 10, the metallic film 5 is deposited on the interlayer insulating film 4 to fill the first pad contact holes 4*a*, the third pad contact holes 4*b*, the first inner relay contact holes 4*c*, the third inner relay contact holes 4*d*, the first outer relay contact holes 4*e*, the third outer relay contact holes 4*f*, and the guard ring contact holes 4*g* and 4*h* by vacuum evaporation or sputtering, for example. The metallic film 5 may be made of a Ti/TiN film, an Al—Si film, and a TiN/Ti film sequentially stacked by a CVD method, for example.

A photoresist film is then coated on the metallic film 5, and is delineated by photolithography. Using the delineated photoresist film as an etching mask, a part of the metallic film 5 is selectively removed, so as to provide the patterns of the pad-forming electrode 51, the first relay wire 52*a* to the fourth relay wire 52*d*, and the guard ring layer 53 separated from each other on the interlayer insulating film 4, as illustrated in FIG. 11.

At the same time, the first electrode contact regions 61*a* buried in the first pad contact holes 4*a* are formed to be in contact with the first resistive layer 31*a*, and the third electrode contact regions 61*c* buried in the third pad contact holes 4*b* are formed to be in contact with the third resistive layer 31*c*. The pad-forming electrode 51 and the first resistive layer 31*a* are thus connected via the first electrode contact regions 61*a*, and the pad-forming electrode 51 and the third resistive layer 31*c* are connected via the third electrode contact regions 61*c*. Although not illustrated, the second electrode contact regions connecting the pad-forming electrode 51 to the second resistive layer 31*b* via the second pad contact holes are formed on the back side of the sheet of FIG. 11. The fourth electrode contact regions connecting the pad-forming electrode 51 to the fourth resistive layer 31*d* via the fourth pad contact holes are formed on the front side of the sheet of FIG. 11.

Further, the first wire contact regions 62*a* buried in the first inner relay contact holes 4*c* are formed to be in contact with the first resistive layer 31*a* together with the formation of the pattern of the first relay wire 52*a*. The first substrate contact regions 63*a* buried in the first outer relay contact holes 4*e* are formed to be in contact with the semiconductor substrate 1. The third wire contact regions 62*c* buried in the third inner relay contact holes 4*d* are formed to be in contact with the third resistive layer 31*c*. The third substrate contact regions 63*c* buried in the third outer relay contact holes 4*f* are formed to be in contact with the semiconductor substrate 1.

Figure 11:
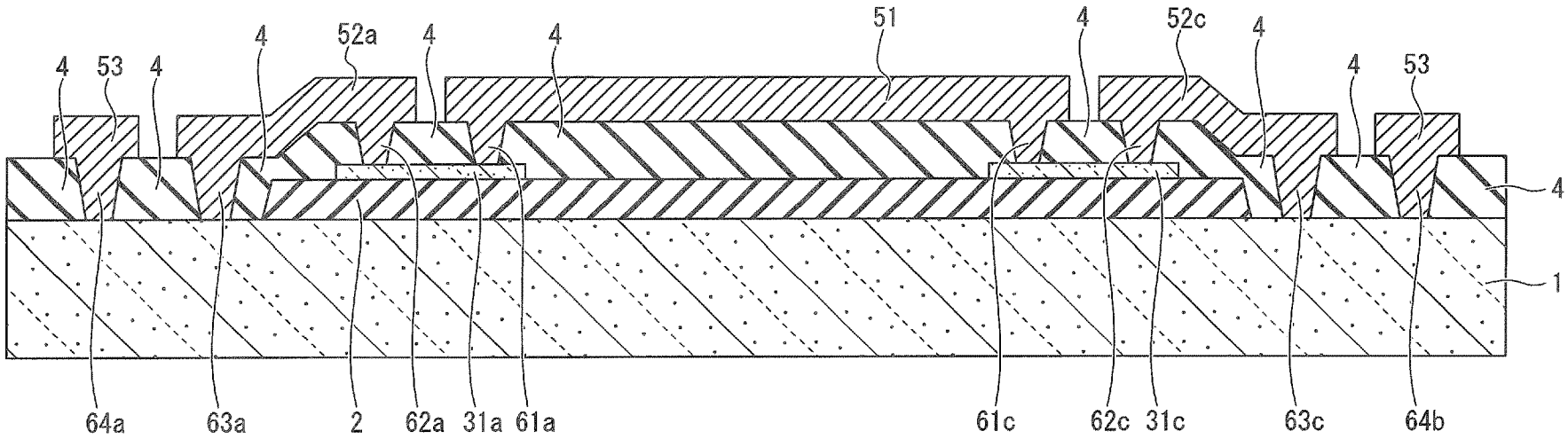
FIG. 11 is a cross-sectional view, continued from FIG. 10, illustrating the process of manufacturing the resistive element according to the embodiment.

Although not illustrated, the second wire contact regions connecting the second resistive layer 31*b* to the second relay wire 52*b* via the second inner relay contact holes, and the second substrate contact regions connecting the second relay wire 52*b* to the semiconductor substrate 1 via the second outer relay contact holes are formed on the back side of the sheet of FIG. 11. The fourth wire contact regions connecting the fourth resistive layer 31*d* to the fourth relay wire 52*d* via the fourth inner relay contact holes, and the fourth substrate contact regions connecting the fourth relay wire 52*d* to the semiconductor substrate 1 via the fourth outer relay contact holes are formed on the front side of the sheet of FIG. 11.

Further, the peripheral contact regions 64*a* and 64*b* buried in the guard ring contact holes 4*g* and 4*h* are formed to be in contact with the semiconductor substrate 1.

Figure 12:
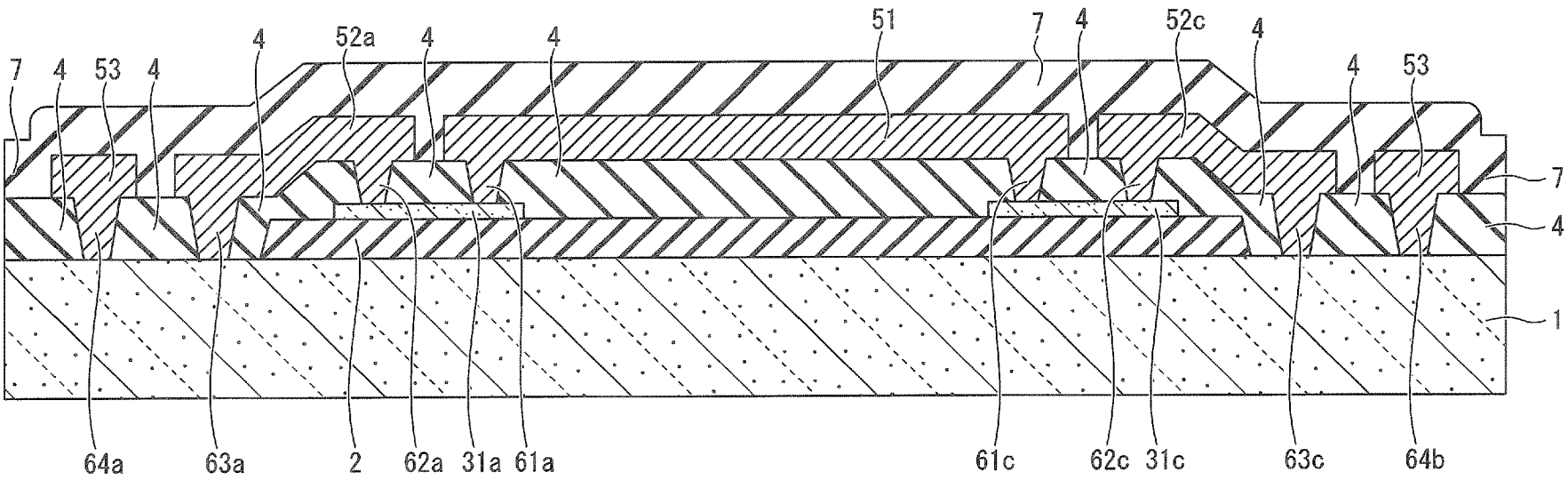
FIG. 12 is a cross-sectional view, continued from FIG. 11, illustrating the process of manufacturing the resistive element according to the embodiment.

Next, as illustrated in FIG. 12, the passivation film 7 is formed on the pad-forming electrode 51, the first relay wire 52*a* to the fourth relay wire 52*d*, and the guard ring layer 53. For example, the passivation film 7 including a TEOS film, a $Si_3N_4$ film, and a polyimide film is formed such that the TEOS film and the $Si_3N_4$ film are sequentially stacked, and the polyimide film is further coated on the stacked film by a plasma CVD method or the like.

Figure 13:
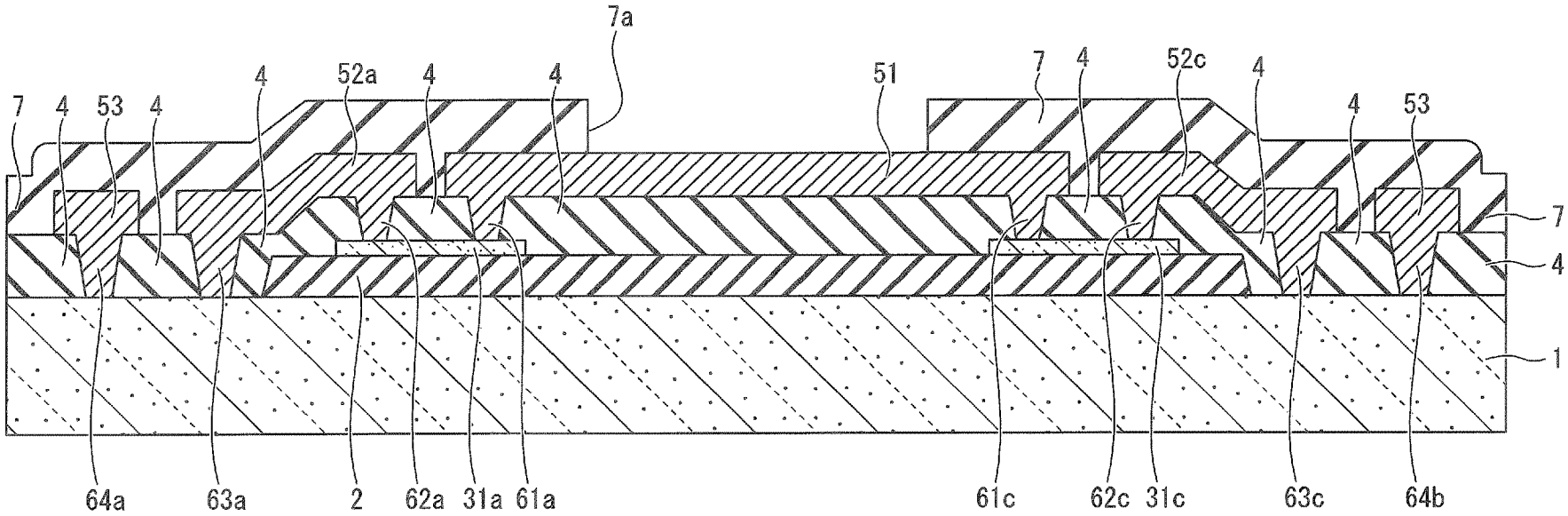
FIG. 13 is a cross-sectional view, continued from FIG. 12, illustrating the process of manufacturing the resistive element according to the embodiment.

A photoresist film is then coated on the passivation film 7, and is delineated by photolithography. Using the delineated photoresist film as an etching mask, a part of the passivation film 7 is selectively removed, so as to provide the opening 7*a* in the passivation film 7, as illustrated in FIG. 13. The part of the pad-forming electrode 51 is exposed on the opening 7*a* so as to serve the pad region.

Next, the bottom surface of the semiconductor substrate 1 is polished by chemical mechanical polishing (CMP) so as to decrease the thickness of the semiconductor substrate 1 to about 350 micrometers. The rear surface electrode 9 illustrated in FIG. 2 is then formed on the bottom surface of the semiconductor substrate 1 by vacuum evaporation or sputtering, for example. A plurality of elements, each being equivalent to the resistive element illustrated in FIG. 1 and FIG. 2, are formed in chip regions arranged into a matrix form in a single wafer. The chip regions are then diced and divided into chips each corresponding to the resistive element as illustrated in FIG. 1 and FIG. 2.

The method of manufacturing the resistive element according to the embodiment facilitates the fabrication of the resistive element with the chip size reduced and the number of the bonding wires decreased. Choosing an appropriate mask in the step illustrated in FIG. 9 to change the presence or absence of the first electrode contact regions 61*a* to the fourth electrode contact regions 61*d*, the first wire contact regions 62*a* to the fourth wire contact regions 62*d*, and the first substrate contact regions 63*a* to the fourth substrate contact regions 63*d*, can selectively use any of or all of the first resistive layer 31*a* to the fourth resistive layer 31*d* so as to adjust the number of the resistive layers connected in parallel.

First Modified Example

Figure 14:
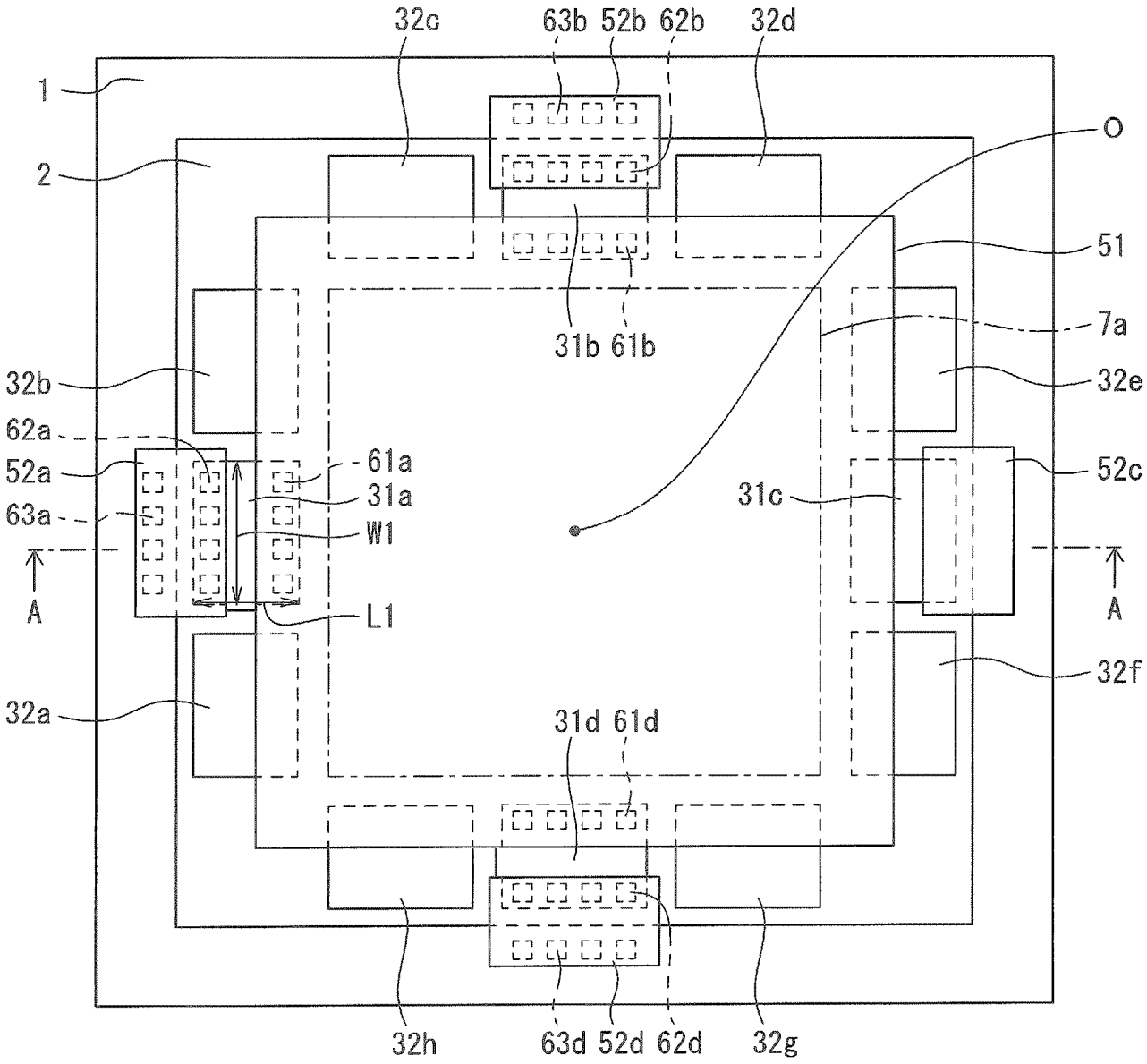
FIG. 14 is a plan view illustrating a resistive element according to a first modified example of the embodiment of the present invention.
Figure 15:
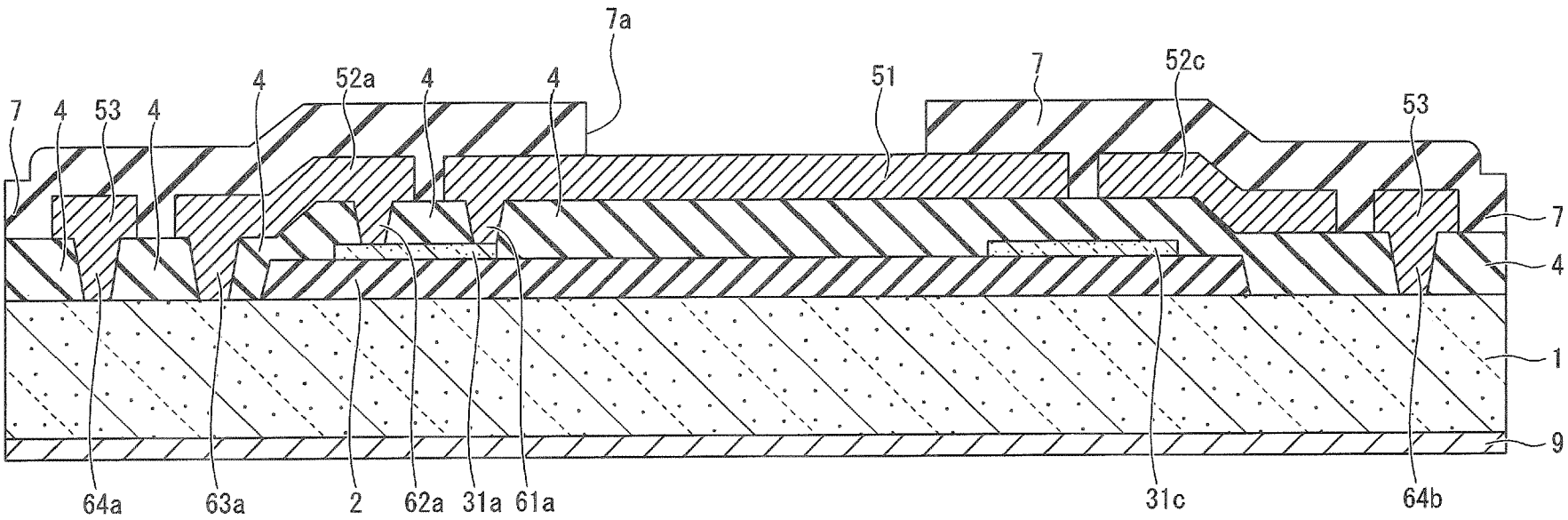
FIG. 15 is a cross-sectional view as viewed from direction A-A in FIG. 14.

A resistive element according to a first modified example of the embodiment of the present invention differs from the resistive element according to the embodiment illustrated in FIG. 1 and FIG. 2 in that three of the first resistive layer 31*a* to the fourth resistive layer 31*d*, which are the first resistive layer 31*a*, the second resistive layer 31*b*, and the fourth resistive layer 31*d*, are selectively used and connected in parallel, as illustrated in FIG. 14 and FIG. 15. The resistive element according to the first modified example is not provided with the third electrode contact regions 61*c* connecting the pad-forming electrode 51 and the third resistive layer 31*c*, the third wire contact regions 62*c* connecting the third resistive layer 31*c* and the third relay wire 52*c*, or the third substrate contact regions 63*c* connecting the third relay wire 52*c* and the semiconductor substrate 1 illustrated in FIG. 1 and FIG. 2. The other configurations of the resistive element according to the first modified example are the same as those of the resistive element according to the embodiment illustrated in FIG. 1 and FIG. 2, and overlapping explanations are not repeated below.

The resistive element according to the first modified example including the three resistive layers of the first resistive layer 31*a*, the second resistive layer 31*b*, and the fourth resistive layer 31*d*, is decreased in the number of the resistive layers connected in parallel as compared with the resistive element according to the embodiment illustrated in FIG. 1 and FIG. 2, so as to increase the resistance value of the resistive element according to the first modified example.

A method of manufacturing the resistive element according to the first modified example can use a mask different from that used in the step illustrated in FIG. 9 in the method of manufacturing the resistive element according to the embodiment, so as to exclude the step of forming the third electrode contact regions 61*c*, the third wire contact regions 62*c*, and the third substrate contact regions 63*c*. The other steps of the method of manufacturing the resistive element according to the first modified example are the same as those of the manufacturing method for the resistive element according to the embodiment described above, and overlapping explanations are not repeated below.

Second Modified Example

Figure 16:
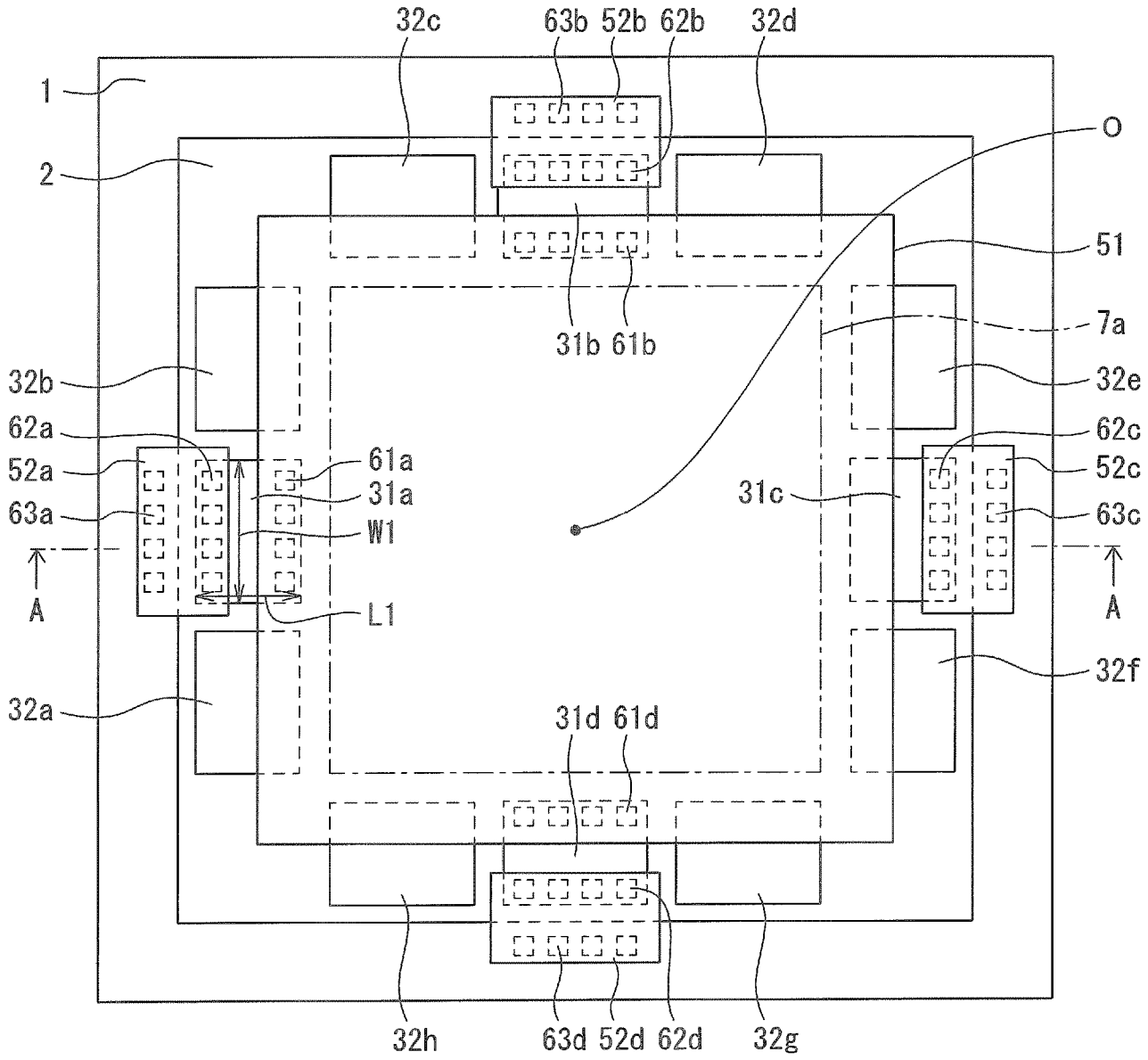
FIG. 16 is a plan view illustrating a resistive element according to a second modified example of the embodiment of the present invention.
Figure 17:
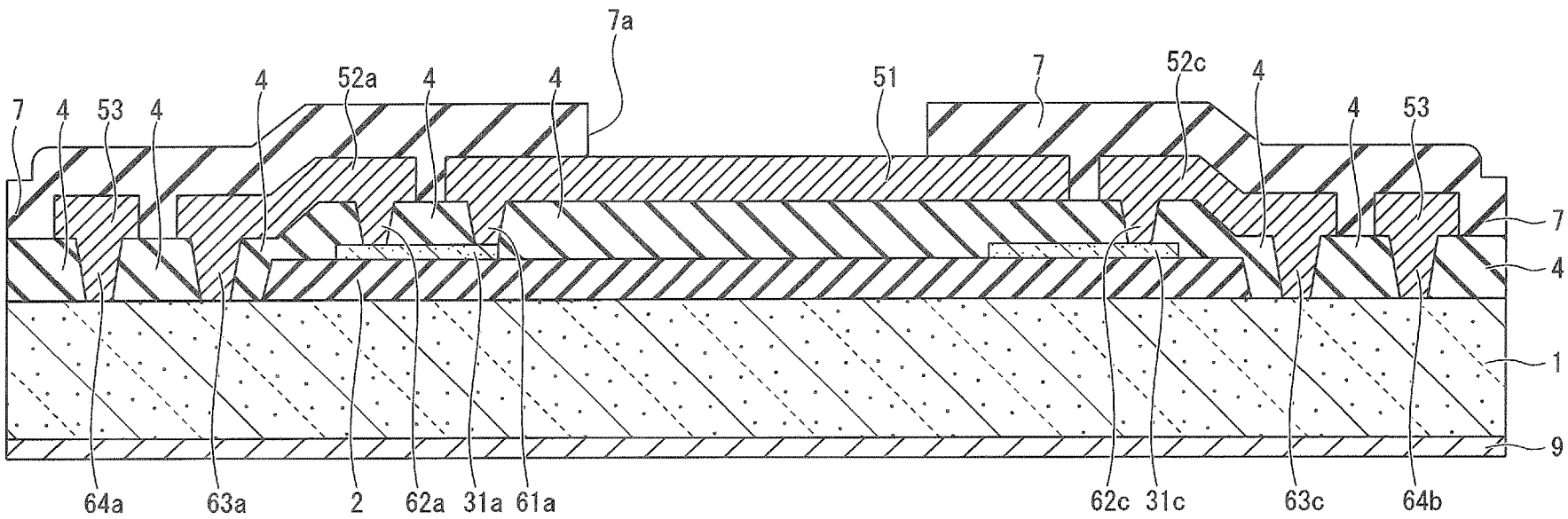
FIG. 17 is a cross-sectional view as viewed from direction A-A in FIG. 16.

A resistive element according to a second modified example of the embodiment of the present invention has a configuration common to the resistive element according to the first modified example illustrated in FIG. 14 and FIG. 15 in that three of the first resistive layer 31*a* to the fourth resistive layer 31*d*, which are the first resistive layer 31*a*, the second resistive layer 31*b*, and the fourth resistive layer 31*d*, are selectively used and connected in parallel, as illustrated in FIG. 16 and FIG. 17. The resistive element according to the second modified example differs from the resistive element according to the first modified example illustrated in FIG. 14 and FIG. 15 in excluding only the third electrode contact regions 61*c* connecting the pad-forming electrode 51 and the third resistive layer 31*c*, while including the third wire contact regions 62*c* connecting the third resistive layer 31*c* and the third relay wire 52*c* and the third substrate contact regions 63*c* connecting the third relay wire 52*c* and the semiconductor substrate 1 illustrated in FIG. 1 and FIG. 2. The other configurations of the resistive element according to the second modified example are the same as those of the resistive element according to the first modified example illustrated in FIG. 14 and FIG. 15, and overlapping explanations are not repeated below.

The resistive element according to the second modified example only excluding the third electrode contact regions 61*c* can lead the third resistive layer 31*c* not to be used. The resistive element according to the second modified example can lead the third resistive layer 31*c* not to be used also when excluding either the third wire contact regions 62*c* or the third substrate contact regions 63*c* while including the third electrode contact regions 61*c*. Namely, the resistive element according to the second modified example can lead the third resistive layer 31*c* not to be used when excluding at least one of the third electrode contact regions 61*c*, the third wire contact regions 62*c*, and the third substrate contact regions 63*c*.

A method of manufacturing the resistive element according to the second modified example can use a mask different from that used in the step illustrated in FIG. 9 in the method of manufacturing the resistive element according to the embodiment, so as to exclude the step of forming the third electrode contact regions 61*c*.

Third Modified Example

Figure 18:
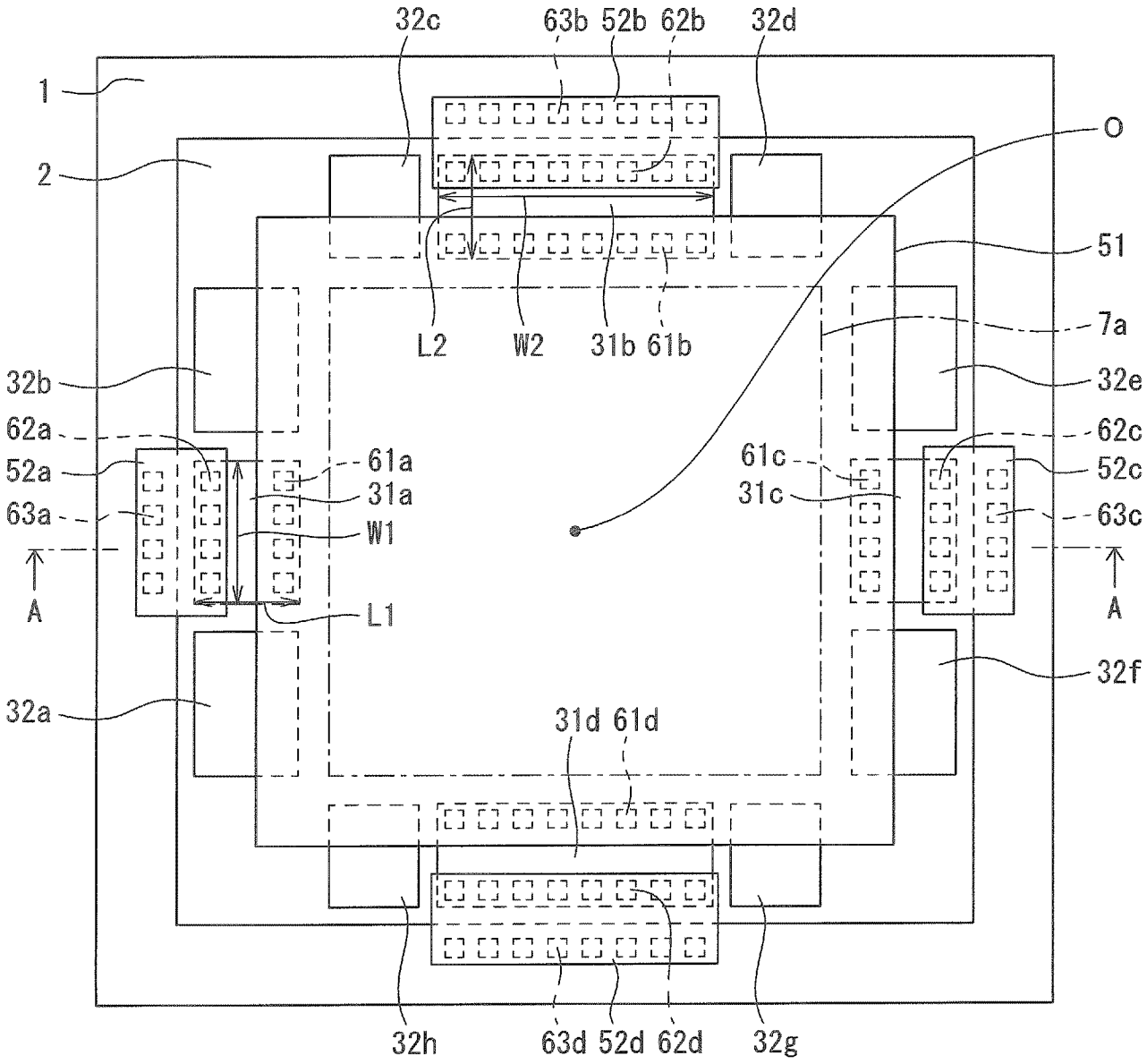
FIG. 18 is a plan view illustrating a resistive element according to a third modified example of the embodiment of the present invention.

A resistive element according to a third modified example of the embodiment of the present invention differs from the resistive element according to the embodiment illustrated in FIG. 1 and FIG. 2 in that the width W1 of the first resistive layer 31*a* and the third resistive layer 31*c* is different from the width W2 of the second resistive layer 31*b* and the fourth resistive layer 31*d*, as illustrated in FIG. 18. The width W1 of the first resistive layer 31*a* and the third resistive layer 31*c* is smaller than the width W2 of the second resistive layer 31*b* and the fourth resistive layer 31*d*, and the resistance value is thus greater for the first resistive layer 31*a* and the third resistive layer 31*c* than for the second resistive layer 31*b* and the fourth resistive layer 31*d*. The other configurations of the resistive element according to the third modified example are the same as those of the resistive element according to the embodiment illustrated in FIG. 1 and FIG. 2, and overlapping explanations are not repeated below.

The resistive element according to the third modified example has a configuration in which the width W1 of the first resistive layer 31*a* and the third resistive layer 31*c* is different from the width W2 of the second resistive layer 31*b* and the fourth resistive layer 31*d*, so as to allow the resistance value of the first resistive layer 31*a* and the third resistive layer 31*c* and the resistance value of the second resistive layer 31*b* and the fourth resistive layer 31*d* to differ from each other. This expands the possibility of the resistance value to be set in the resistive element according to the third modified example when selectively using the first resistive layer 31*a* to the fourth resistive layer 31*d*. The resistive element according to the third modified example has been illustrated with the case of leading the resistance value of the first resistive layer 31*a* and the third resistive layer 31*c* to differ from the resistance value of the second resistive layer 31*b* and the fourth resistive layer 31*d*, but is not limited to this case. For example, the respective widths of the first resistive layer 31*a* to the fourth resistive layer 31*d* may differ from each other so as to change the respective resistance values of the first resistive layer 31*a* to the fourth resistive layer 31*d* from each other.

Fourth Modified Example

Figure 19:
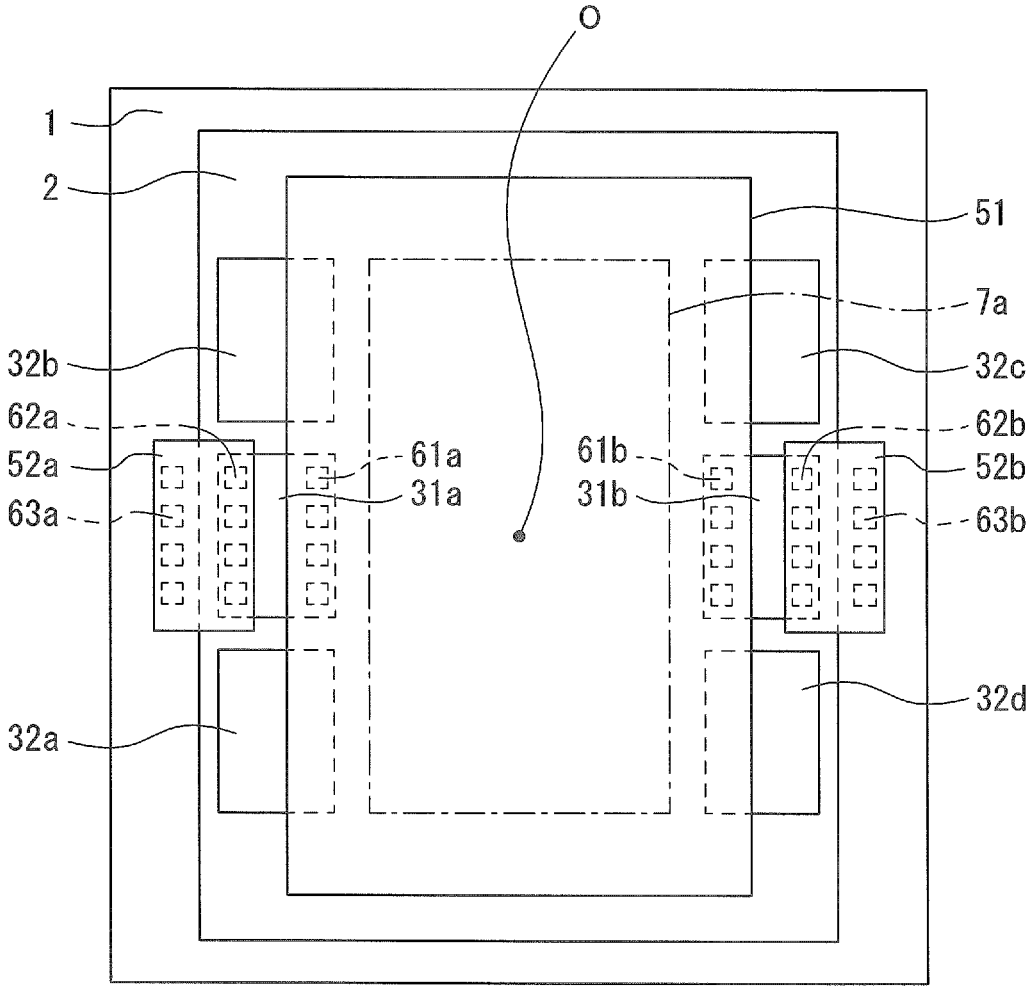
FIG. 19 is a plan view illustrating a resistive element according to a fourth modified example of the embodiment of the present invention.

A resistive element according to a fourth modified example of the embodiment of the present invention differs from the resistive element according to the embodiment illustrated in FIG. 1 and FIG. 2 in that the two resistive layers of the first resistive layer 31*a* and the second resistive layer 31*b* are arranged on the opposite sides to interpose the pad-forming electrode 51, as illustrated in FIG. 19. The planar pattern including the first resistive layer 31*a*, the second resistive layer 31*b*, the pad-forming electrode 51, the first relay wire 52*a*, and the second relay wire 52*b* has two-fold rotational symmetry about the center O of the chip, so as to allow the resistive element according to the fourth modified example to be turned by 180 degrees upon packaging to facilitate the process of assembly. The other configurations of the resistive element according to the fourth modified example are the same as those of the resistive element according to the embodiment illustrated in FIG. 1 and FIG. 2, and overlapping explanations are not repeated below.

The resistive element according to the fourth modified example including the two resistive layers can selectively use one of or both of the first resistive layer 31*a* and the second resistive layer 31*b* such that the presence or absence of each of the first electrode contact regions 61*a* and the second electrode contact regions 61*b*, the first wire contact regions 62*a* and the second wire contact regions 62*b*, and the first substrate contact regions 63*a* and the second substrate contact regions 63*b* is determined.

Fifth Modified Example

Figure 20:
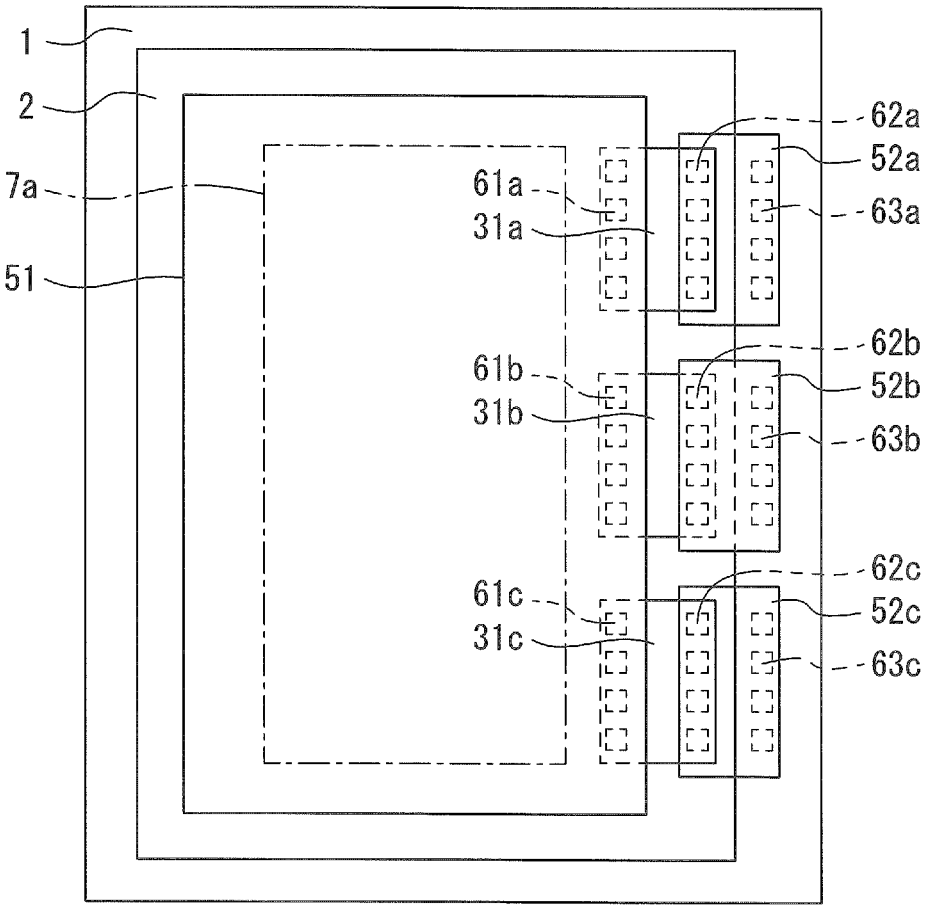
FIG. 20 is a plan view illustrating a resistive element according to a fifth modified example of the embodiment of the present invention.

A resistive element according to a fifth modified example of the embodiment of the present invention differs from the resistive element according to the embodiment illustrated in FIG. 1 and FIG. 2 in that a plurality of (three) resistive layers, the first resistive layer 31*a* to the third resistive layer 31*c*, are arranged on one side of the rectangular planar pattern of the pad-forming electrode 51, as illustrated in FIG. 20. The other configurations of the resistive element according to the fifth modified example are the same as those of the resistive element according to the embodiment illustrated in FIG. 1 and FIG. 2, and overlapping explanations are not repeated below.

The resistive element according to the fifth modified example including the three resistive layers of the first resistive layer 31*a* to the third resistive layer 31*c* on one side of the rectangular planar pattern of the pad-forming electrode 51, can selectively use any of or all of the first resistive layer 31*a* to the third resistive layer 31*c* such that the presence or absence of each of the first electrode contact regions 61*a* to the third electrode contact regions 61*c*, the first wire contact regions 62*a* to the third wire contact regions 62*c*, and the first substrate contact regions 63*a* to the third substrate contact regions 63*c* is determined.

Sixth Modified Example

Figure 21:
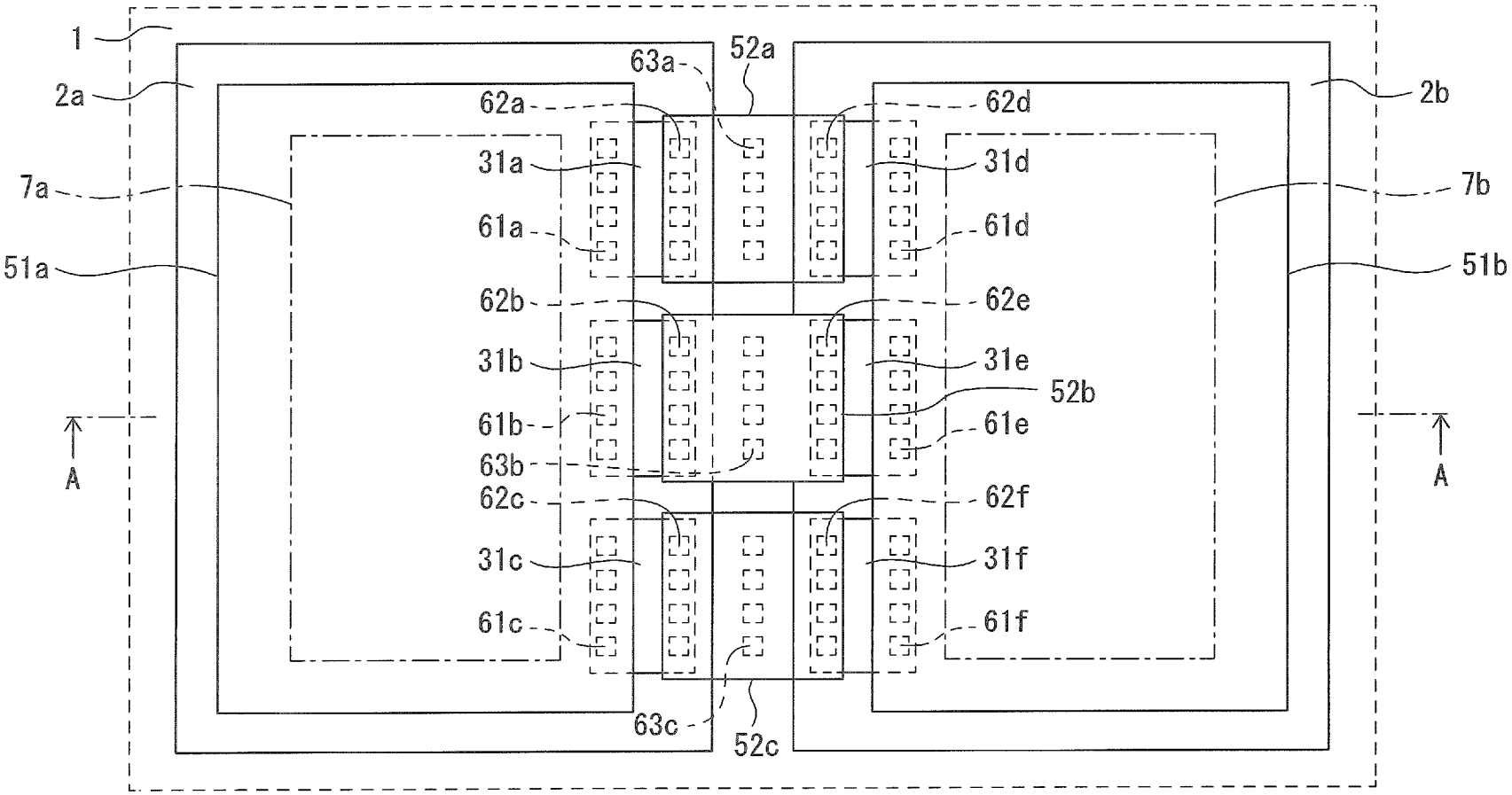
FIG. 21 is a plan view illustrating a resistive element according to a sixth modified example of the embodiment of the present invention.
Figure 22:
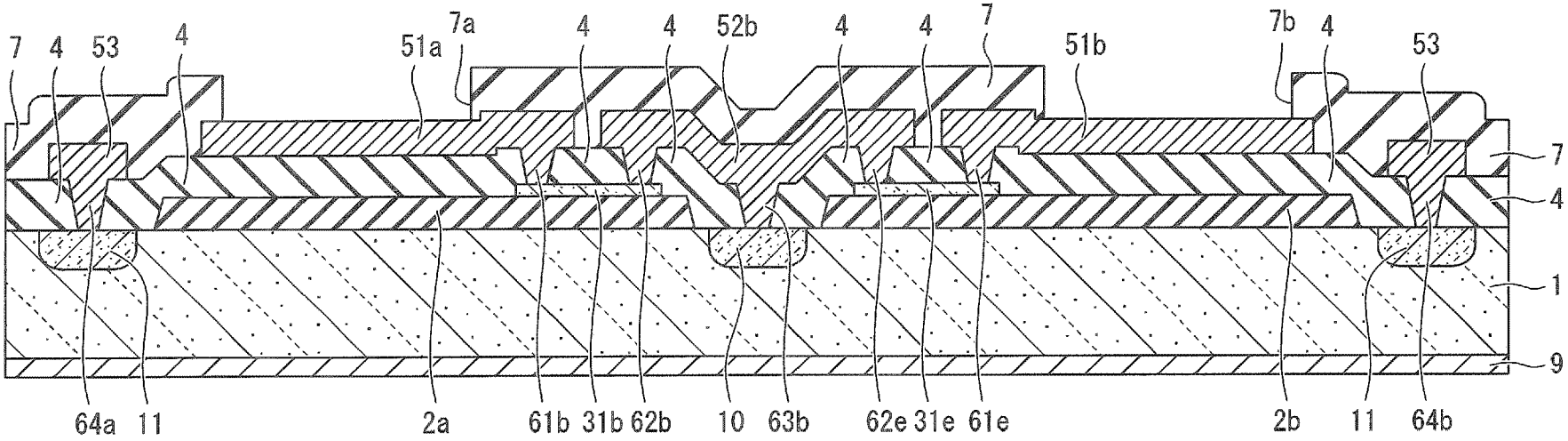
FIG. 22 is a cross-sectional view as viewed from direction A-A in FIG. 21.

A resistive element according to a sixth modified example of the embodiment of the present invention differs from the resistive element according to the embodiment illustrated in FIG. 1 and FIG. 2 in including a plurality of (two) pad-forming electrodes, a first pad-forming electrode 51*a* and a second pad-forming electrode 51*b*, arranged separately from each other, and further including a first resistive layer 31*a* to a sixth resistive layer 31*f* between the first pad-forming electrode Ma and the second pad-forming electrode 51*b*, as illustrated in FIG. 21 and FIG. 22.

The first pad-forming electrode Ma is connected with the respective edges on one side of the first resistive layer 31*a* to the third resistive layer 31*c* via the first electrode contact regions 61*a* to the third electrode contact regions 61*c*. The respective edges on the other side of the first resistive layer 31*a* to the third resistive layer 31*c* are connected with the first relay wire 52*a* to the third relay wire 52*c* via the first wire contact regions 62*a* to the third wire contact regions 62*c*. The first relay wire 52*a* to the third relay wire 52*c* are connected to the semiconductor substrate 1 via the first substrate contact regions 63*a* to the third substrate contact regions 63*c*. A first contact region 10*a* to a third contact region 10*c* and a peripheral contact region 11 having the same conductivity type as the semiconductor substrate 1 and having a higher impurity concentration (a lower specific resistivity) than the semiconductor substrate 1, are provided in the upper portion of the semiconductor substrate 1 at the contact positions between the semiconductor substrate 1 and each of the first substrate contact regions 63*a* to the third substrate contact regions 63*c*. The contact regions 10 and the periphery contact region 11 may also be provided in the other examples of the embodiment.

The second pad-forming electrode 51*b* is connected with the respective edges on one side of the fourth resistive layer 31*d* to the sixth resistive layer 31*f* via the fourth electrode contact regions 61*d* to the sixth electrode contact regions 61*f*. The respective edges on the other side of the fourth resistive layer 31*d* to the sixth resistive layer 31*f* are connected with the first relay wire 52*a* to the third relay wire 52*c* via the fourth wire contact regions 62*d* to the sixth wire contact regions 62*f* The resistive element according to the sixth modified example can be used as the pair of the first gate resistive element R1 and the second gate resistive element R2 illustrated in FIG. 3, for example. The other configurations of the resistive element according to the sixth modified example are the same as those of the resistive element according to the embodiment illustrated in FIG. 1 and FIG. 2, and overlapping explanations are not repeated below.

The resistive element according to the sixth modified example including the plural (two) pad-forming electrodes of the first pad-forming electrode Ma and the second pad-forming electrode 51*b*, can selectively use any of or all of the first resistive layer 31*a* to the sixth resistive layer 31*f* such that the presence or absence of each of the first electrode contact regions 61*a* to the sixth electrode contact regions 61*f*, the first wire contact regions 62*a* to the sixth wire contact regions 62*f*, and the first substrate contact regions 63*a* to the sixth substrate contact regions 63*f* is determined.

Seventh Modified Example

Figure 23:
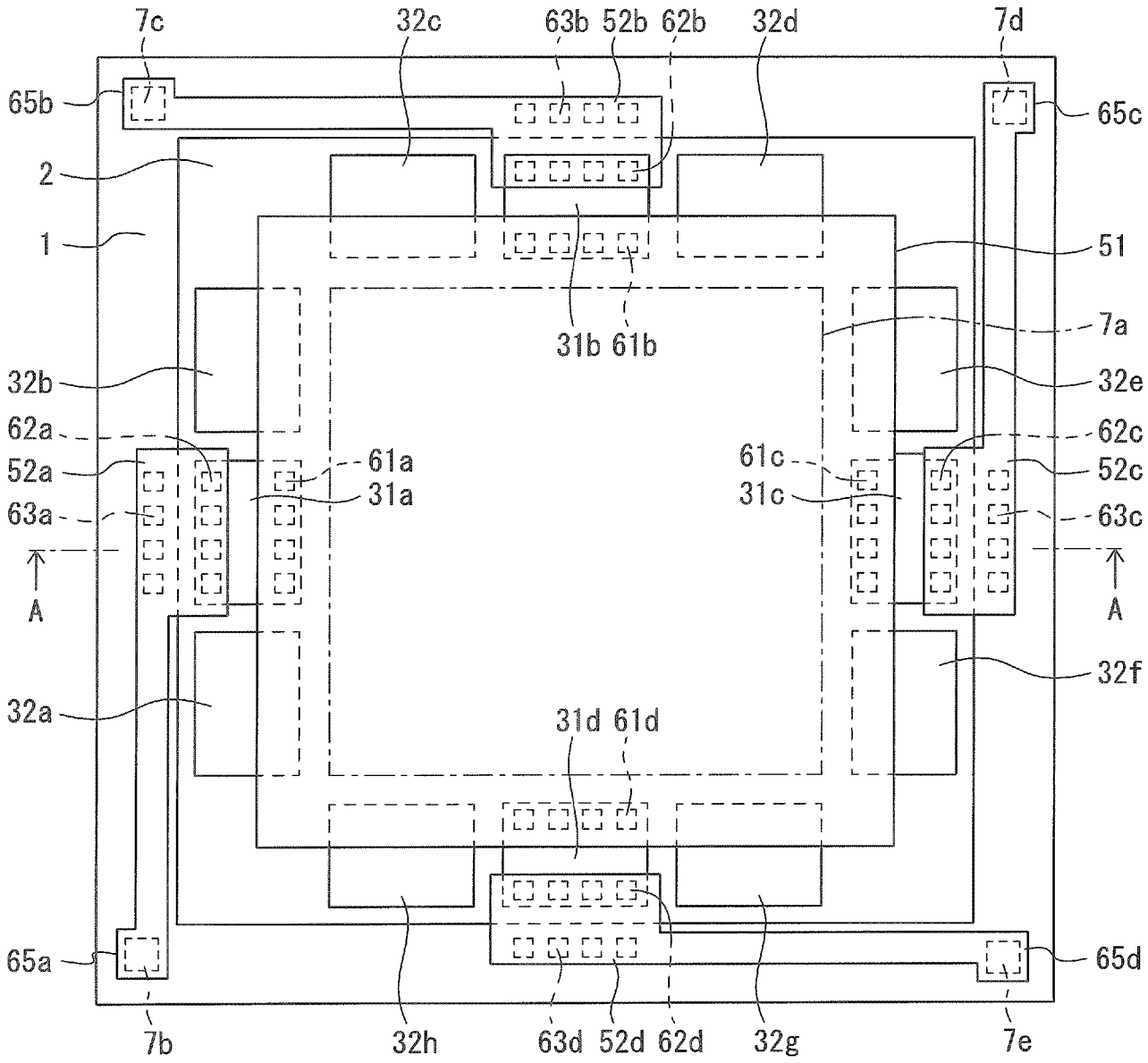
FIG. 23 is a plan view illustrating a resistive element according to a seventh modified example of the embodiment of the present invention.

A resistive element according to a seventh modified example of the embodiment of the present invention differs from the resistive element according to the embodiment illustrated in FIG. 1 and FIG. 2 in including a first auxiliary pad 65*a* to a fourth auxiliary pad 65*d* electrically connected to the first relay wire 63*a* to the fourth relay wire 63*d*, as illustrated in FIG. 23. FIG. 23 omits the illustration of the passivation insulating film, and only indicates openings 7*b* to 7*e* of the passivation insulating film by the broken lines. The first auxiliary pad 65*a* to the fourth auxiliary pad 65*d* are exposed to the openings 7*b* to 7*e* of the passivation insulating film. The first auxiliary pad 65*a* to the fourth auxiliary pad 65*d* include the same material as the first relay wire 63*a* to the fourth relay wire 63*d*, and can be formed simultaneously with the first relay wire 63*a* to the fourth relay wire 63*d*. The other configurations of the resistive element according to the seventh modified example are the same as those of the resistive element according to the embodiment illustrated in FIG. 1 and FIG. 2, and overlapping explanations are not repeated below.

Figure 24:
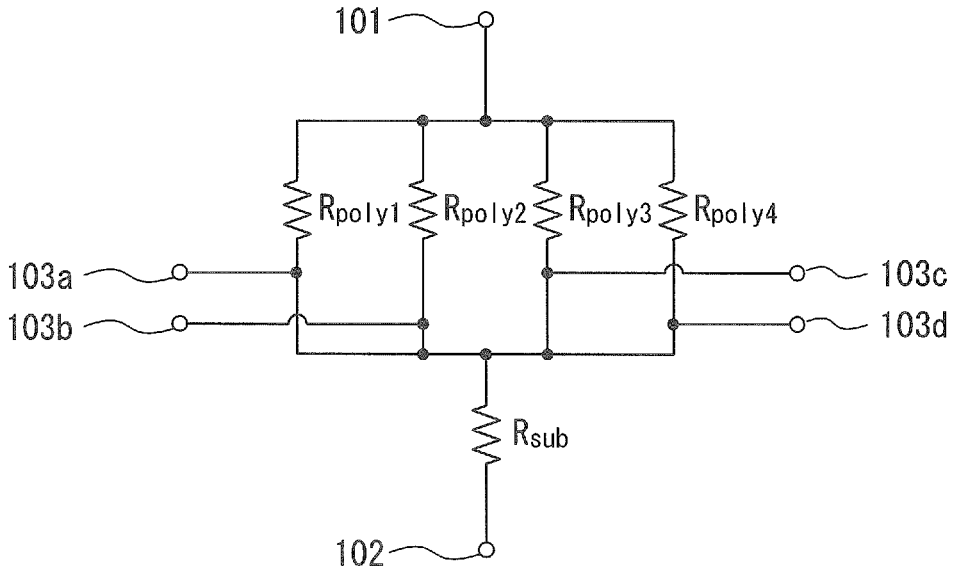
FIG. 24 is an equivalent circuit diagram of the resistive element according to the seventh modified example of the embodiment.

FIG. 24 is an equivalent circuit diagram of the resistive element according to the seventh modified example of the embodiment of the present invention. In FIG. 24, the pad-forming electrode 51 corresponds to a pad-side terminal 101, the rear surface electrode 9 corresponds to a rear surface-side terminal 102, and the first auxiliary pad 65*a* to the fourth auxiliary pad 65*d* correspond to auxiliary terminals 103*a* to 103*d*. Resistors $R_{poly1}$ to $R_{poly4}$ connected in parallel corresponding to the first resistive layer 31*a* to the fourth resistive layer 31*d* are connected in series to a resistor $R_{sub}$ of the semiconductor substrate 1 between the pad-side terminal 101 and the rear surface-side terminal 102. The auxiliary terminals 103*a* to 103*d* are connected between the resistor $R_{sub}$ of the semiconductor substrate 1 and each of the resistors $R_{poly1}$ to $R_{poly4}$ corresponding to the first resistive layer 31*a* to the fourth resistive layer 31*d*.

The resistive element according to the seventh modified example including the first auxiliary pad 65*a* to the fourth auxiliary pad 65*d*, can measure the electric characteristics of the resistors $R_{poly1}$ to $R_{poly4}$ corresponding to the first resistive layer 31*a* to the fourth resistive layer 31*d*, excluding the component of the resistor $R_{sub}$ of the semiconductor substrate 1, between the pad-forming electrode 51 and each of the first auxiliary pad 65*a* to the fourth auxiliary pad 65*d*.

Eighth Modified Example

Figure 25:
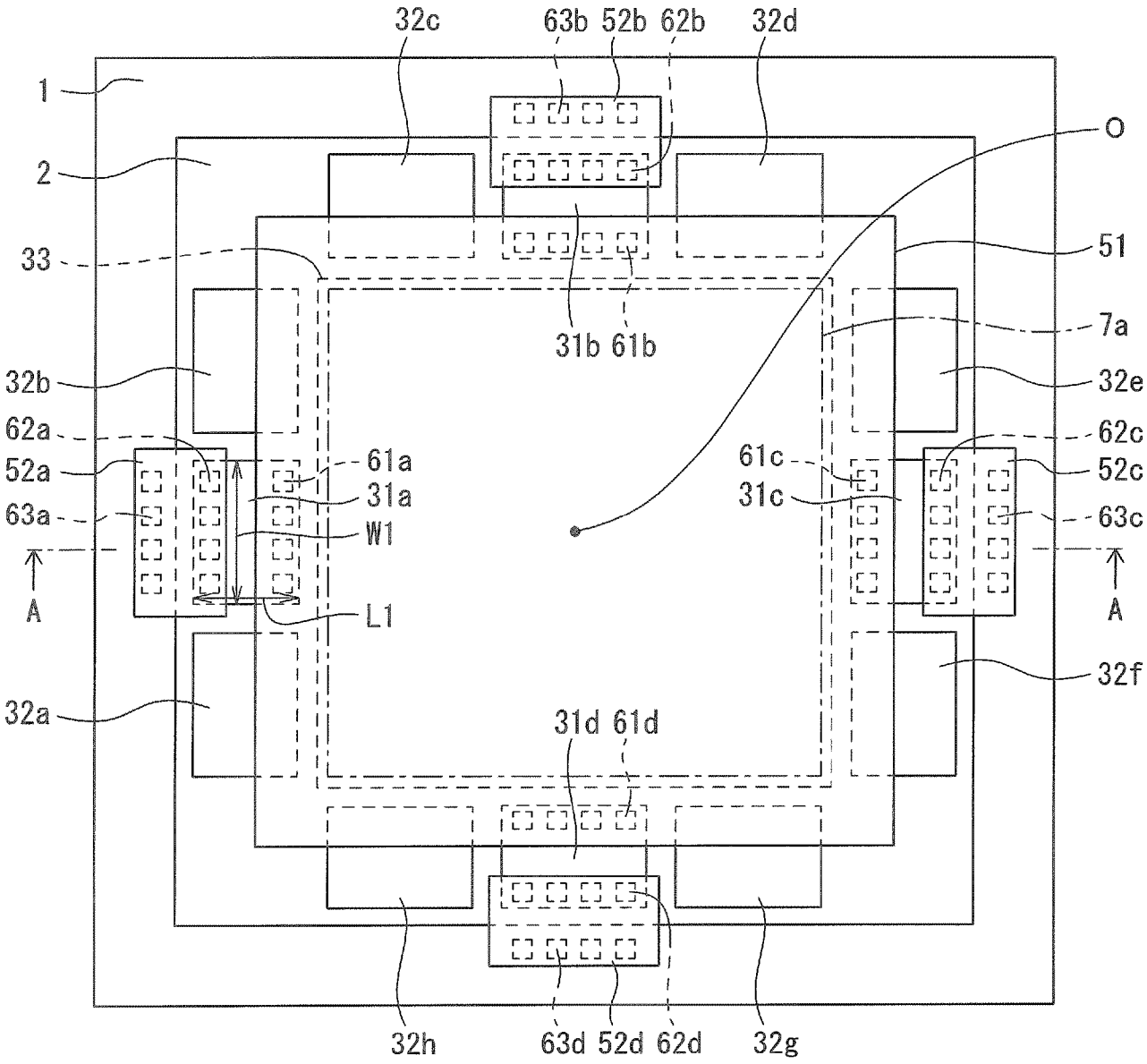
FIG. 25 is a plan view illustrating a resistive element according to an eighth modified example of the embodiment of the present invention.
Figure 26:
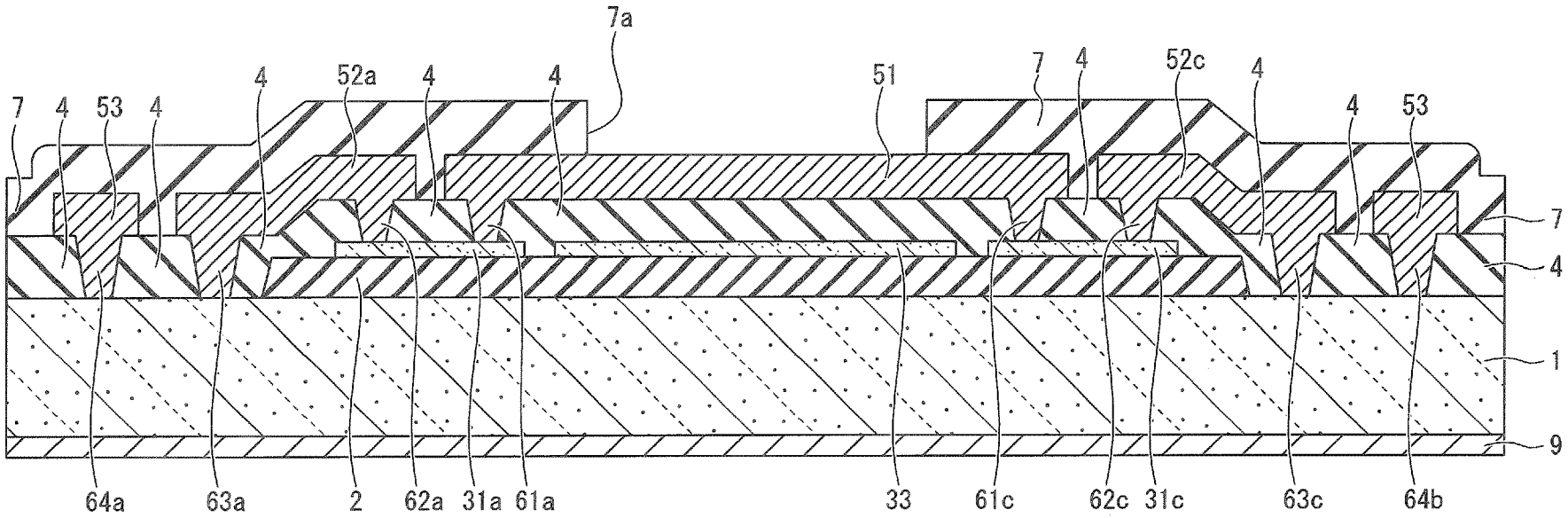
FIG. 26 is a cross-sectional view as viewed from direction A-A in FIG. 25.

A resistive element according to an eighth modified example of the embodiment of the present invention differs from the resistive element according to the embodiment illustrated in FIG. 1 and FIG. 2 in including an auxiliary film 33 in a floating state in terms of electric potential allocated on the field insulating film 2 and separated from the first resistive layer 31*a* to the fourth resistive layer 31*d*, as illustrated in FIG. 25 and FIG. 26.

The auxiliary film 33 is deposited under the pad-forming electrode 51 and is separated from the first resistive layer 31*a* to the fourth resistive layer 31*d*. The auxiliary film 33 includes the same material as the first resistive layer 31*a* to the fourth resistive layer 31*d*, such as n-type DOPOS, and has the same thickness as the first resistive layer 31*a* to the fourth resistive layer 31*d*. The auxiliary film 33 has a rectangular planar pattern, for example. The auxiliary film 33 may be obtained such that a part of the DOPOS layer 3 is selectively removed so as to be formed together with the first resistive layer 31*a* to the fourth resistive layer 31*d* in the step illustrated in FIG. 13. The other configurations of the resistive element according to the eighth modified example are the same as those of the resistive element according to the embodiment illustrated in FIG. 1, and overlapping explanations are not repeated below.

The resistive element according to the eighth modified example including the auxiliary film 33 in the floating state allocated on the field insulating film 2, can reduce a parasitic capacitance under the pad-forming electrode 51, as in the case of increasing the thickness of the field insulating film 2. The resistive element according to the eighth modified example thus can avoid a decrease in the total resistance upon a reduction in impedance during operation at a high frequency, so as to prevent an oscillation phenomenon.

Ninth Modified Example

Figure 27:
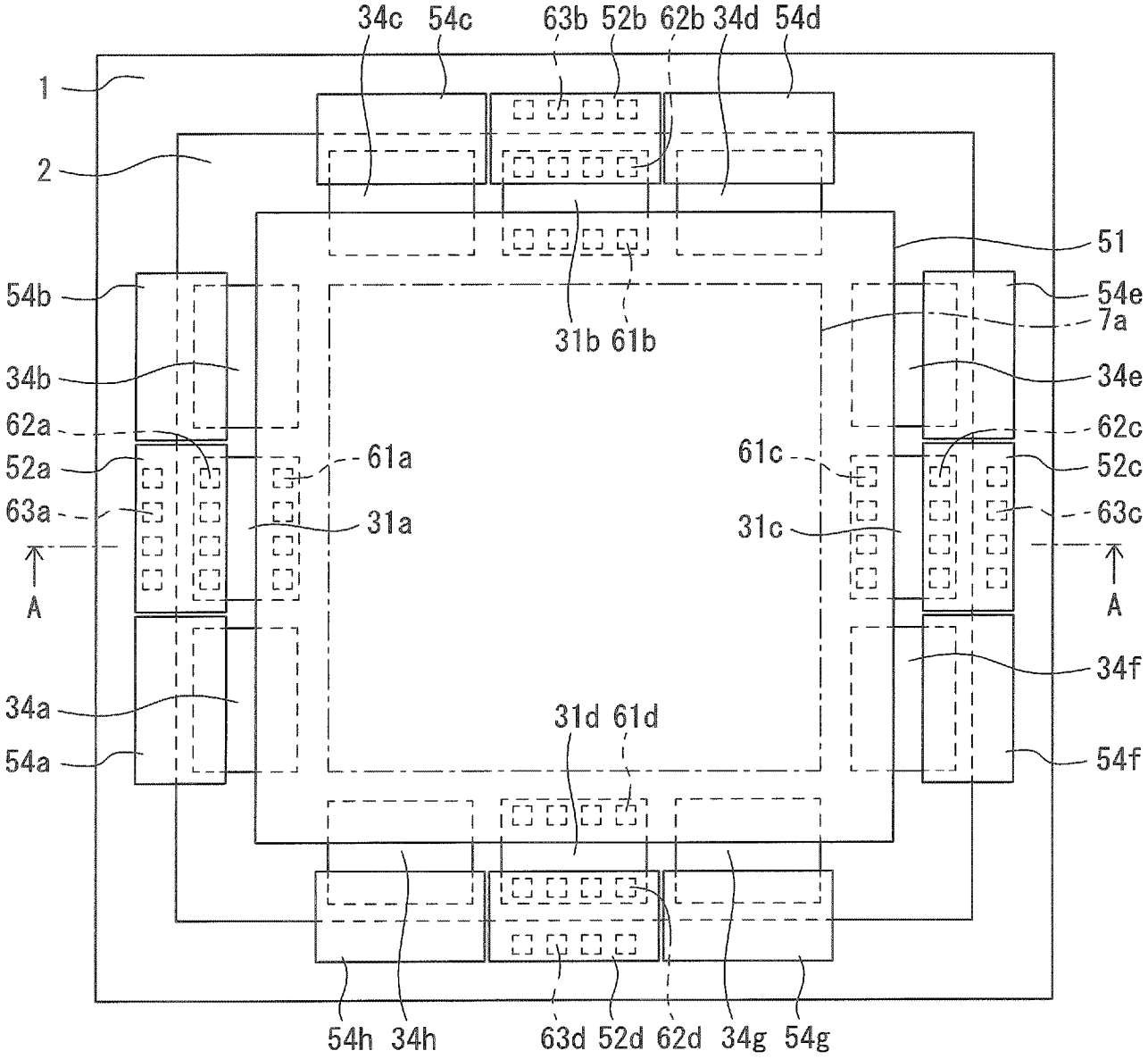
FIG. 27 is a plan view illustrating a resistive element according to a ninth modified example of the embodiment of the present invention.

A resistive element according to a ninth modified example of the embodiment of the present invention differs from the resistive element according to the embodiment illustrated in FIG. 1 and FIG. 2 in further including a fifth resistive layer 34*a* to a twelfth resistive layer 34*h* and a fifth relay wire 54*a* to a twelfth relay wire 54*h*, as illustrated in FIG. 27. The fifth resistive layer 34*a* and the sixth resistive layer 34*b* are arranged to interpose the first resistive layer 31*a*. The seventh resistive layer 34*c* and the eighth resistive layer 34*d* are arranged to interpose the second resistive layer 31*b*. The ninth resistive layer 34*e* and the tenth resistive layer 34*f* are arranged to interpose the third resistive layer 31*c*. The eleventh resistive layer 34*g* and the twelfth resistive layer 34*h* are arranged to interpose the fourth resistive layer 31*d*.

The fifth relay wire 54*a* and the sixth relay wire 54*b* are arranged to interpose the first relay wire 52*a*. The seventh relay wire 54*c* and the eighth relay wire 54*d* are arranged to interpose the second relay wire 52*b*. The ninth relay wire 54*e* and the tenth relay wire 54*f* are arranged to interpose the third relay wire 52*c*. The eleventh relay wire 54*g* and the twelfth relay wire 54*h* are arranged to interpose the fourth relay wire 52*d*. The other configurations of the resistive element according to the ninth modified example are the same as those of the resistive element according to the embodiment illustrated in FIG. 1 and FIG. 2, and overlapping explanations are not repeated below.

The resistive element according to the ninth modified example can increase/decrease the number of the first resistive layer 31*a* to the fourth resistive layer 31*d* connected in parallel, and the number of the fifth resistive layer 34*a* to the twelfth resistive layer 34*h* connected in parallel such that the presence or absence of the fifth electrode contact regions to the twelfth electrode contact regions, the fifth wire contact regions to the twelfth wire contact regions, and the fifth substrate contact regions to the twelfth substrate contact regions used for connecting the fifth resistive layer 34*a* to the twelfth resistive layer 34*h* connected in parallel is determined, so as to regulate the resistance value of the resistive element according to the ninth modified example more finely. The resistive element according to the ninth modified example is not limited to the number or the arranged positions of the resistive layers described above, which can be determined as appropriate.

Tenth Modified Example

Figure 28:
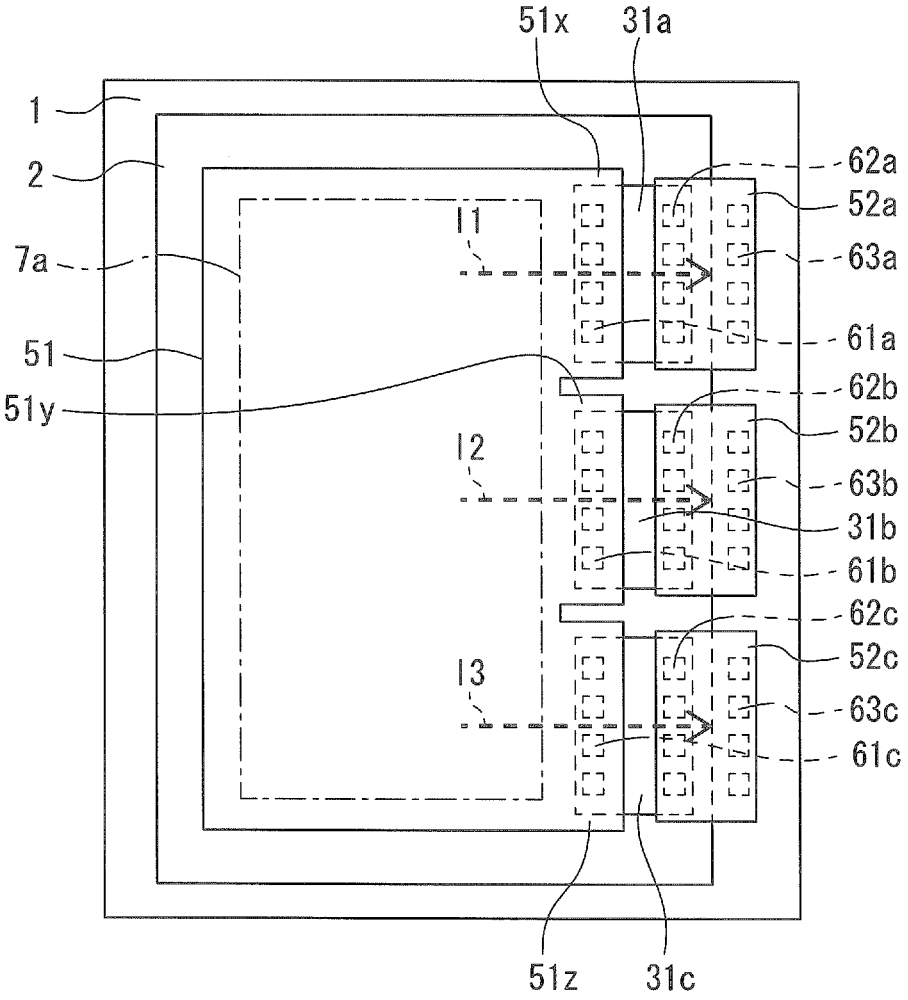
FIG. 28 is a plan view illustrating a resistive element according to a tenth modified example of the embodiment of the present invention.

A resistive element according to a tenth modified example of the embodiment of the present invention differs from the resistive element according to the embodiment illustrated in FIG. 1 and FIG. 2 in including a first projection 51*x* to a third projection 51*z* on one side of the rectangular planar pattern of the pad-forming electrode 51, as illustrated in FIG. 28. The first projection 51*x* is connected to one edge of the first resistive layer 31*a* via the first electrode contact regions 61*a*. The second projection 51*y* is connected to one edge of the second resistive layer 31*b* via the second electrode contact regions 61*b*. The third projection 51*z* is connected to one edge of the third resistive layer 31*c* via the third electrode contact regions 61*c*.

The other edge of the first resistive layer 31*a* is connected to the first relay wire 52*a* via the first wire contact regions

62*a*. The other edge of the second resistive layer 31*b* is connected to the second relay wire 52*b* via the second wire contact regions 62*b*. The other edge of the third resistive layer 31*c* is connected to the third relay wire 52*c* via the third wire contact regions 62*c*.

The first relay wire 52*a* is connected to the semiconductor substrate 1 via the first substrate contact regions 63*a*. The second relay wire 52*b* is connected to the semiconductor substrate 1 via the second substrate contact regions 63*b*. The third relay wire 52*c* is connected to the semiconductor substrate 1 via the third substrate contact regions 63*c*.

The resistive element according to the tenth modified example has a configuration in which the three resistive layers of the first resistive layer 31*a* to the third resistive layer 31*c* are connected in parallel. As schematically indicated by the arrows in FIG. 28, a first current channel I1 is formed through which a current flows from the first projection 51*x* of the pad-forming electrode 51 to the semiconductor substrate 1 via the first resistive layer 31*a* and the first relay wire 52*a*. A second current channel 12 is also formed through which a current flows from the second projection 51*y* of the pad-forming electrode 51 to the semiconductor substrate 1 via the second resistive layer 31*b* and the second relay wire 52*b*. A third current channel 13 is also formed through which a current flows from the third projection 51*z* of the pad-forming electrode 51 to the semiconductor substrate 1 via the third resistive layer 31*c* and the third relay wire 52*c*. The other configurations of the resistive element according to the tenth modified example are the same as those of the resistive element according to the embodiment illustrated in FIG. 1 and FIG. 2, and overlapping explanations are not repeated below.

The resistive element according to the tenth modified example including the three resistive layers of the first resistive layer 31*a* to the third resistive layer 31*c*, can selectively use any of or all of the first resistive layer 31*a* to the third resistive layer 31*c* such that the presence or absence of each of the first electrode contact regions 61*a* to the third electrode contact regions 61*c*, the first wire contact regions 62*a* to the third wire contact regions 62*c*, and the first substrate contact regions 63*a* to the third substrate contact regions 63*c* is determined.

Eleventh Modified Example

Figure 29:
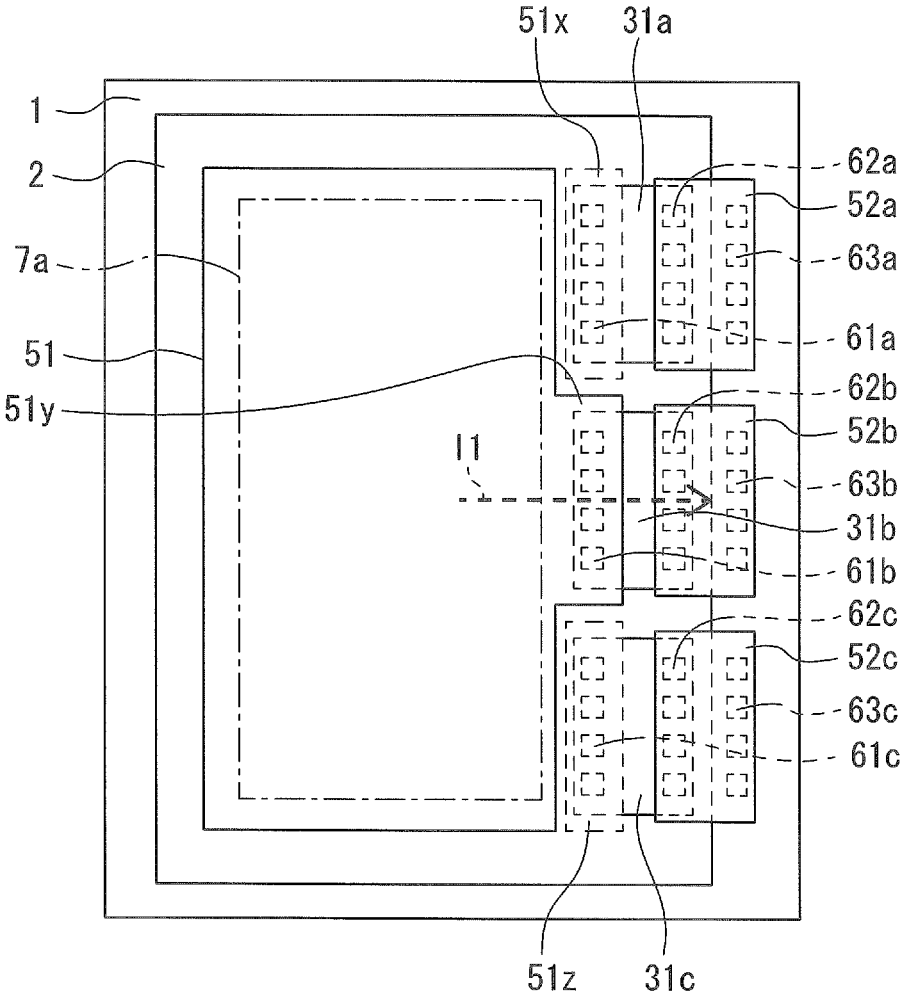
FIG. 29 is a plan view illustrating a resistive element according to an eleventh modified example of the embodiment of the present invention.

A resistive element according to an eleventh modified example of the embodiment of the present invention differs from the resistive element according to the tenth modified example illustrated in FIG. 28 in that the first projection 51*x* and the third projection 51*z* are separated from the pad-forming electrode 51, as illustrated in FIG. 29. The resistive element according to the eleventh modified example has a configuration in which the current channel I1 is formed through which a current flows from the second projection 51*y* of the pad-forming electrode 51 to the semiconductor substrate 1 via the second resistive layer 31*b* and the second relay wire 52*b*. The other configurations of the resistive element according to the eleventh modified example are the same as those of the resistive element according to the tenth modified example illustrated in FIG. 28, and overlapping explanations are not repeated below.

The resistive element according to the eleventh modified example selectively separates the first projection 51*x* to the third projection 51*z* from the pad-forming electrode 51, without changing the presence or absence of the first electrode contact regions 61*a* to the third electrode contact regions 61*c*, the first wire contact regions 62*a* to the third wire contact regions 62*c*, or the first substrate contact regions 63*a* to the third substrate contact regions 63*c*, so as to selectively use any of or all of the first resistive layer 31*a* to the third resistive layer 31*c*.

Twelfth Modified Example

Figure 30:
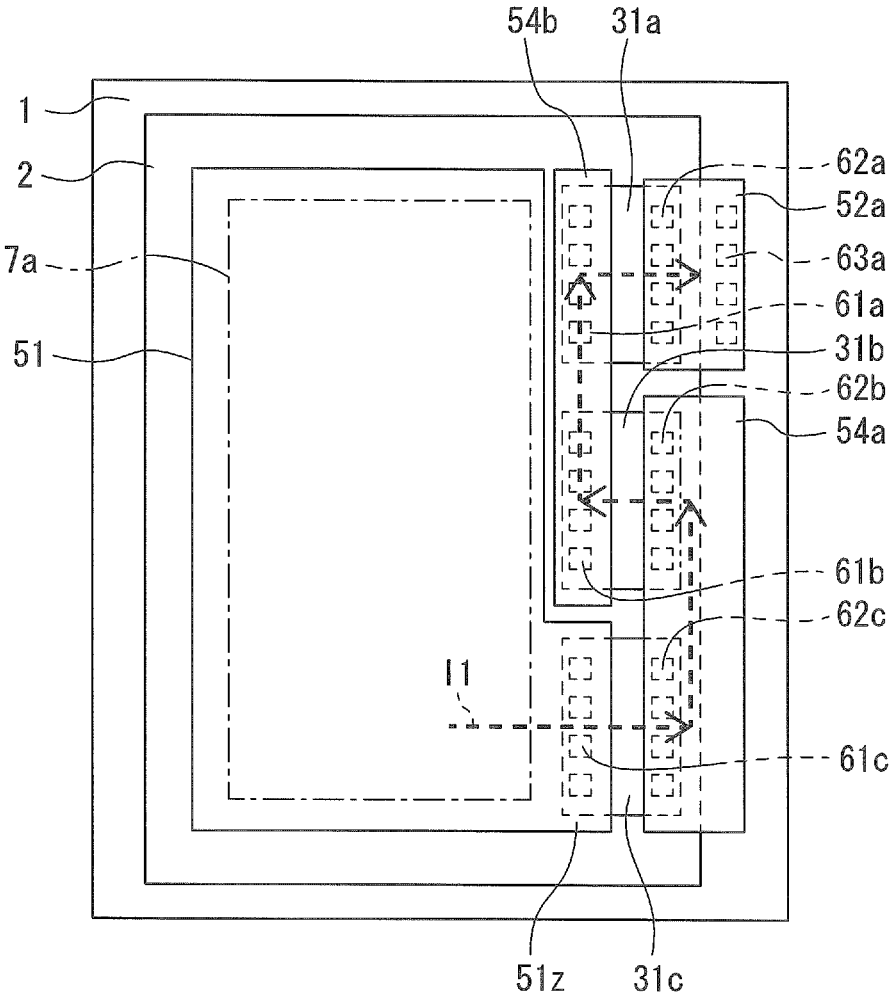
FIG. 30 is a plan view illustrating a resistive element according to a twelfth modified example of the embodiment of the present invention.

A resistive element according to a twelfth modified example of the embodiment of the present invention differs from the resistive element according to the tenth modified example illustrated in FIG. 28 in that a plurality of (three) resistive layers, the first resistive layer 31*a* to the third resistive layer 31*c*, are connected in series, as illustrated in FIG. 30. The resistive element according to the twelfth modified example includes a first inter-resistor wire 54*a* at a position in which the second relay wire 52*b* and the third relay wire 52*c* illustrated in FIG. 28 are located, and a second inter-resistor wire 54*b* at a position in which the first projection 51*x* and the second projection 51*y* illustrated in FIG. 28 are located.

The first inter-resistor wire 54*a* is connected to the second resistive layer 31*b* and the third resistive layer 31*c* via the second wire contact regions 62*b* and the third wire contact regions 62*c*. The second inter-resistor wire 54*b* is connected to the first resistive layer 31*a* and the second resistive layer 31*b* via the first electrode contact regions 61*a* and the second electrode contact regions 61*b*.

The resistive element according to the twelfth modified example has a configuration in which the first current channel I1 is formed through which a current flows from the third projection 51*z* of the pad-forming electrode 51 to the semiconductor substrate 1 via the third resistive layer 31*c*, the first inter-resistor wire 54*a*, the second resistive layer 31*b*, the second inter-resistor wire 54*b*, the first resistive layer 31*a*, and the first relay wire 52*a*, as schematically indicated by the arrows in FIG. 30. The other configurations of the resistive element according to the twelfth modified example are the same as those of the resistive element according to the tenth modified example illustrated in FIG. 28, and overlapping explanations are not repeated below.

The resistive element according to the twelfth modified example including the first inter-resistor wire 54*a* and the second inter-resistor wire 54*b* connects the first resistive layer 31*a* to the third resistive layer 31*c* in series, so as to increase the resistance value.

Thirteenth Modified Example

Figure 31:
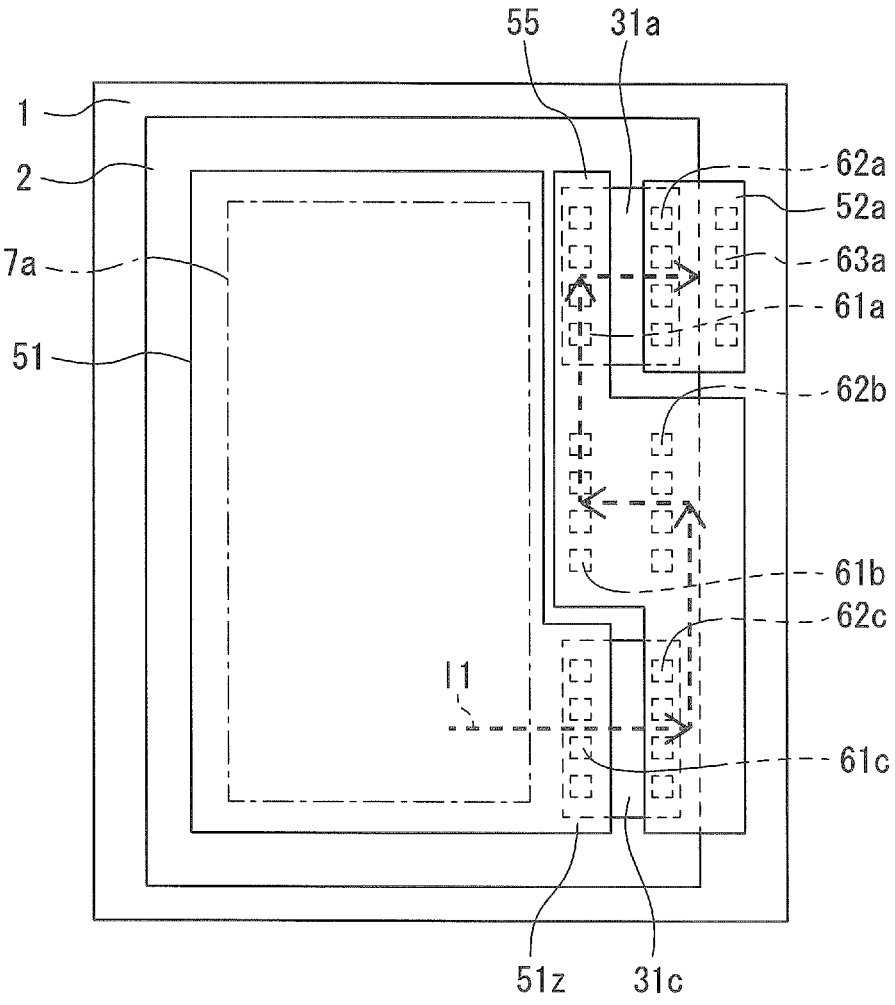
FIG. 31 is a plan view illustrating a resistive element according to a thirteenth modified example of the embodiment of the present invention.

A resistive element according to a thirteenth modified example of the embodiment of the present invention differs from the resistive element according to the tenth modified example illustrated in FIG. 28 in that a plurality of (two) resistive layers, the first resistive layer 31*a* and the third resistive layer 31*c*, are connected in series, as illustrated in FIG. 31. The resistive element according to the thirteenth modified example includes an inter-resistor wire 55 at a position in which the first projection 51*x*, the second projection 51*y*, the second relay wire 52*b*, and the third relay wire 52*c* are located. The inter-resistor wire 55 is connected to the first resistive layer 31*a* via the first electrode contact regions 61*a*, and is connected to the third resistive layer 31*c* via the third wire contact regions 62*c*.

The resistive element according to the thirteenth modified example has a configuration in which the first current channel I1 is formed through which a current flows from the third projection 51*z* of the pad-forming electrode 51 to the semiconductor substrate 1 via the third resistive layer 31*c*, the inter-resistor wire 55, the first resistive layer 31*a*, and the first relay wire 52*a*, as schematically indicated by the arrows in FIG. 31. The other configurations of the resistive element according to the thirteenth modified example are the same as those of the resistive element according to the tenth modified example illustrated in FIG. 28, and overlapping explanations are not repeated below.

The resistive element according to the thirteenth modified example including the inter-resistor wire 55 connects the first resistive layer 31*a* and the third resistive layer 31*c* in series while avoiding the substrate contact adjacent to the pad-forming electrode 51, so as to increase the resistance value.

OTHER EMBODIMENTS

While the present invention has been illustrated by reference to the above embodiment, it should be understood that the present invention is not intended to be limited to the descriptions and the drawings composing part of this disclosure. It will be apparent to those skilled in the art that the present invention includes various alternative embodiments, examples, and technical applications according to the technical idea disclosed in the above embodiments.

While the present invention has been illustrated with the case of using the resistive element according to the embodiment as the first gate resistive element R1 to the twelfth gate resistive element R12 as illustrated in FIG. 3, the resistive element according to the present invention is not limited to the first gate resistive element R1 to the twelfth gate resistive element R12, and may be used as a resistive element for various types of ICs.

What is claimed is:

1. A resistive element comprising:

a semiconductor substrate;

a field insulating film deposited on the semiconductor substrate;

a plurality of resistive layers separately deposited on the field insulating film;

an interlayer insulating film deposited to cover the field insulating film and the plurality of resistive layers;

at least one pad-forming electrode deposited on the interlayer insulating film, and electrically connected to one edge of at least one resistive layer selected from the plurality of resistive layers;

at least one relay wire deposited on the interlayer insulating film separately from the at least one pad-forming electrode, and including a first terminal electrically connected to another edge of the selected resistive layer and a second terminal provided so as to form an ohmic contact to the semiconductor substrate; and a rear surface electrode provided under the semiconductor substrate to form an ohmic contact to the semiconductor substrate, wherein the resistive element uses, as a resistor, an electric channel between the at least one pad-forming electrode and the rear surface electrode.

2. The resistive element of claim 1, wherein:

the at least one pad-forming electrode is electrically connected to the selected resistive layer via an electrode contact region penetrating the interlayer insulating film;

the first terminal is electrically connected to the selected resistive layer via a wire contact region penetrating the interlayer insulating film at a position separated from the electrode contact region; and the second terminal is electrically connected to the semiconductor substrate via a substrate contact region penetrating the interlayer insulating film.

3. The resistive element of claim 1, wherein:

the at least one relay wire comprises a plurality of relay wires corresponding to the plurality of resistive layers;

the at least one pad-forming electrode is electrically connected to one edge of the respective resistive layers;

the respective relay wires are electrically connected to another edge of the corresponding resistive layers; and the plurality of resistive layers are connected in parallel between the at least one pad-forming electrode and the rear surface electrode.

4. The resistive element of claim 1, wherein the plurality of resistive layers have resistance values different from each other.

5. The resistive element of claim 4, wherein the plurality of resistive layers have widths different from each other.

6. The resistive element of claim 1, wherein:

the at least one pad-forming electrode comprises a plurality of pad-forming electrodes;

the respective one edges of the resistive layers are connected to the corresponding pad-forming electrodes; and the at least one relay wire is interposed between the plural pad-forming electrodes, and includes a plurality of the first terminals connected to the respective other edges of the corresponding resistive layers.

7. The resistive element of claim 1, further comprising an auxiliary pad electrically connected to the at least one relay wire.

8. The resistive element of claim 1, wherein the plurality of resistive layers are connected in series between the at least one pad-forming electrode and the rear surface electrode.

9. A method of manufacturing a resistive element, comprising:

depositing a field insulating film on a semiconductor substrate;

depositing a plurality of resistive layers on the field insulating film;

depositing an interlayer insulating film to cover the field insulating film and the plurality of resistive layers;

forming, in the interlayer insulating film, a first contact hole on which one edge of one resistive layer selected from the plurality of resistive layers is exposed, a second contact hole on which another edge of the selected resistive layer is exposed at position separated from the first contact hole, and a third contact hole on which a top surface of the semiconductor substrate is partly exposed at position separated from the first and second contact holes;

forming a pad-forming electrode electrically connected to the one edge of the selected resistive layer via the first contact hole, and a relay wire electrically connected to another edge of the selected resistive layer via the second contact hole to form an ohmic contact to the semiconductor substrate via the third contact hole; and forming a rear surface electrode under the semiconductor substrate, wherein the resistive element uses, as a resistor, an electric channel between the at least one pad-forming electrode and the rear surface electrode.

* * * * *